US011217370B2

(12) United States Patent
Wang et al.

(10) Patent No.: US 11,217,370 B2
(45) Date of Patent: Jan. 4, 2022

(54) PRESERVATION OF STRAIN IN IRON NITRIDE MAGNET

(71) Applicant: REGENTS OF THE UNIVERSITY OF MINNESOTA, Minneapolis, MN (US)

(72) Inventors: Jian-Ping Wang, Shoreview, MN (US); YanFeng Jiang, Minneapolis, MN (US)

(73) Assignee: REGENTS OF THE UNIVERSITY OF MINNESOTA, Minneapolis, MN (US)

( * ) Notice: Subject to any disclaimer, the term of this patent is extended or adjusted under 35 U.S.C. 154(b) by 530 days.

(21) Appl. No.: 15/546,387

(22) PCT Filed: Jan. 22, 2016

(86) PCT No.: PCT/US2016/014446
§ 371 (c)(1),
(2) Date: Jul. 26, 2017

(87) PCT Pub. No.: WO2016/122971
PCT Pub. Date: Aug. 4, 2016

(65) Prior Publication Data

US 2017/0365381 A1 Dec. 21, 2017

Related U.S. Application Data

(60) Provisional application No. 62/107,733, filed on Jan. 26, 2015.

(51) Int. Cl.
*H01F 1/047* (2006.01)
*H01F 1/00* (2006.01)
(Continued)

(52) U.S. Cl.
CPC ..... *H01F 1/047* (2013.01); *C22C 38/001* (2013.01); *C23C 8/02* (2013.01); *C23C 8/18* (2013.01);
(Continued)

(58) Field of Classification Search
CPC ..... C22C 38/001; C23C 8/02; C23C 8/24; C23C 8/26; H01F 1/0063; H01F 1/047; H01F 41/0253
(Continued)

(56) References Cited

U.S. PATENT DOCUMENTS 9,715,957 B2 * 7/2017 Wang ..... H01F 1/055
10,072,356 B2 * 9/2018 Wang ..... C22C 33/0292
(Continued)

FOREIGN PATENT DOCUMENTS

JP 05311390 A 11/1993
JP 06096947 A 4/1994
(Continued)

OTHER PUBLICATIONS

International Search Report from PCT/US2016/014446 as prepared by the ISA/KR; dated Apr. 29, 2016.
(Continued)

*Primary Examiner* — Jie Yang
(74) *Attorney, Agent, or Firm* — BakerHostetler

(57) ABSTRACT

A permanent magnet may include a Fe16N2 phase in a strained state. In some examples, strain may be preserved within the permanent magnet by a technique that includes etching an iron nitride-containing workpiece including Fe16N2 to introduce texture, straining the workpiece, and annealing the workpiece. In some examples, strain may be preserved within the permanent magnet by a technique that includes applying at a first temperature a layer of material to an iron nitride-containing workpiece including Fe16N2, and
(Continued)

bringing the layer of material and the iron nitride-containing workpiece to a second temperature, where the material has a different coefficient of thermal expansion than the iron nitride-containing workpiece. A permanent magnet including an Fe16N2 phase with preserved strain also is disclosed.

13 Claims, 23 Drawing Sheets

(51) Int. Cl.

| | |
|---|---|
| ***H01F 41/02*** | (2006.01) |
| ***C22C 38/00*** | (2006.01) |
| ***C23C 8/60*** | (2006.01) |
| ***C23C 8/02*** | (2006.01) |
| ***C23C 8/80*** | (2006.01) |
| ***C23C 8/24*** | (2006.01) |
| ***C23C 8/18*** | (2006.01) |
| ***C23C 8/26*** | (2006.01) |

(52) U.S. Cl.
CPC ..... *C23C 8/24* (2013.01); *C23C 8/26* (2013.01); *C23C 8/60* (2013.01); *C23C 8/80* (2013.01); *H01F 1/0063* (2013.01); *H01F 41/0253* (2013.01)

(58) Field of Classification Search
USPC ..... 148/101
See application file for complete search history.

(56) References Cited

U.S. PATENT DOCUMENTS

| | | | |
|---|---|---|---|
| 2009/0087688 | A1 | 4/2009 | Masaki |
| 2010/0104767 | A1 | 4/2010 | Sskuma et al. |

FOREIGN PATENT DOCUMENTS

| | | | |
|---|---|---|---|
| WO | 2014124135 | A2 | 8/2014 |
| WO | 2016/022711 | A1 | 2/2016 |

OTHER PUBLICATIONS

Yang Meiyin et al: "The effect of strain 1-13 INV. induced by Ag underlayer on saturation H01FI/147 magnetization of partially ordered FeI6N2thin films", Applied Physics Letters, A I P Publishing LLC, US, vol. 103, No. 24, 242412-1-242412-4 Dec. 9, 2013 (Dec. 9, 2013), XP012179462.

Ji Nian et al.: "Strain induced giant 1-8, magnetism in epitaxial FeNthin film", Applied Physics Letters, A I P Publishing LLC, US, vol. 102, No. 7, Feb. 18, 2013 (Feb. 18, 2013), pp. 72411-1-72411-4, XP012170128.

* cited by examiner

Annealing below 200°C

PRESERVATION OF STRAIN IN IRON NITRIDE MAGNET

CROSS-REFERENCE TO RELATED APPLICATIONS

This application is a National Stage of International Patent Application No. PCT/US2016/014446, filed Jan. 22, 2016, and claims the benefit of U.S. Provisional Patent Application No. 62/107,733, filed Jan. 26, 2015, both applications titled "PRESERVATION OF STRAIN IN IRON NITRIDE MAGNET," the entire contents of which are incorporated herein by reference for all purposes.

GOVERNMENT INTEREST IN INVENTION

This invention was made with Government support under contract number DE-AR0000199 awarded by DOE, Office of ARPA-E. The government has certain rights in this invention.

TECHNICAL FIELD

The disclosure relates to permanent magnets and techniques for forming permanent magnets.

BACKGROUND

Permanent magnets play a role in many electro-mechanical systems, including, for example, alternative energy systems. For example, permanent magnets are used in electric motors or generators, which may be used in vehicles, wind turbines, and other alternative energy mechanisms. Many permanent magnets in current use include rare earth elements, such as neodymium. These rare earth elements are in relatively short supply, and may face increased prices and/or supply shortages in the future. Additionally, some permanent magnets that include rare earth elements are expensive to produce. For example, fabrication of NdFeB magnets generally includes crushing material, compressing the material, and sintering at temperatures over 1000° C.

SUMMARY

In general, this disclosure is directed to bulk permanent magnets that include $Fe_{16}N_2$ and techniques for forming bulk permanent magnets that include $Fe_{16}N_2$. Bulk $Fe_{16}N_2$ permanent magnets may provide an alternative to permanent magnets that include a rare earth element. Iron and nitrogen are abundant elements, and thus are relatively inexpensive and easy to procure. Additionally, experimental evidence gathered from thin film $Fe_{16}N_2$ permanent magnets suggests that bulk $Fe_{16}N_2$ permanent magnets may have desirable magnetic properties, including an energy product of as high as about 134 MegaGauss*Oerstads (MGOe), which is about two times the energy product of NdFeB (about 60 MGOe). The high energy product of $Fe_{16}N_2$ magnets may provide high efficiency for applications in electric motors, electric generators, and magnetic resonance imaging (MRI) magnets, among other applications.

In some aspects, the disclosure describes techniques for forming bulk $Fe_{16}N_2$ permanent magnets. The techniques may generally include straining an iron wire or sheet, that includes at least one body centered cubic (bcc) iron crystal, along a direction substantially parallel to a <001> crystal axis of the at least one bcc iron crystal. In some examples, the <001> crystal axis of the at least one iron wire or sheet may lie substantially parallel to a major axis of the iron wire or sheet. The techniques then include exposing the iron wire or sheet to a nitrogen environment to introduce nitrogen into the iron wire or sheet. The techniques further include annealing the nitridized iron wire or sheet to order the arrangement of iron and nitrogen atoms and form the $Fe_{16}N_2$ phase constitution in at least a portion of the iron wire or sheet. In some examples, multiple $Fe_{16}N_2$ wires or sheets can be assembled with substantially parallel <001> axes and the multiple $Fe_{16}N_2$ wires or sheets can be pressed together to form a permanent magnet including a $Fe_{16}N_2$ phase constitution.

In some aspects, the disclosure describes techniques for forming single crystal iron nitride wires and sheets. In some examples, a Crucible technique, such as that described herein, may be used to form single crystal iron nitride wires and sheets. In addition to such Crucible techniques, such single crystal iron wires and sheets may be formed by either the micro melt zone floating or pulling from a micro shaper. Furthermore, techniques for forming crystalline textured (e.g., with desired crystalline orientation along the certain direction of wires and sheets) iron nitride wires and sheet are also described.

In one example, the disclosure is directed to a method that includes straining an iron wire or sheet comprising at least one iron crystal in a direction substantially parallel to a <001> crystal axis of the iron crystal; nitridizing the iron wire or sheet to form a nitridized iron wire or sheet; and annealing the nitridized iron wire or sheet to form a $Fe_{16}N_2$ phase constitution in at least a portion of the nitridized iron wire or sheet.

In another example, the disclosure is directed to a system that includes means for straining an iron wire or sheet comprising at least one body centered cubic (bcc) iron crystal in a direction substantially parallel to a <001> axis of the bcc iron crystal; means for heating the strained iron wire or sheet; means for exposing the strained iron wire or sheet to an atomic nitrogen precursor to form a nitridized iron wire or sheet; and means for annealing the nitridized iron wire or sheet to form a $Fe_{16}N_2$ phase constitution in at least a portion of the nitridized iron wire or sheet.

In another aspect, the disclosure is directed to a method that includes urea, amines, or ammonium nitrate as effective atomic nitrogen sources to diffuse nitrogen atoms into iron to form a nitridized iron wire or sheet or bulk.

In another aspect, the disclosure is directed to a permanent magnet that includes a wire comprising a $Fe_{16}N_2$ phase constitution.

In another aspect, the disclosure is directed to a permanent magnet that includes a sheet comprising a $Fe_{16}N_2$ phase constitution.

In another aspect, the disclosure is directed to a permanent magnet that includes a $Fe_{16}N_2$ phase constitution. According to this aspect of the disclosure, the permanent magnet has a size in at least one dimension of at least 0.1 mm.

In another example, the disclosure is directed to a technique that includes etching an iron nitride-containing workpiece to form crystallographic texture in the iron nitride-containing workpiece; straining the iron nitride-containing workpiece; and annealing the iron nitride-containing workpiece to form a $Fe_{16}N_2$ phase in at least a portion of the iron nitride-containing workpiece, where the texture substantially preserves the strain within the annealed iron nitride-containing workpiece including the $Fe_{16}N_2$ phase.

In another aspect, the disclosure is directed to applying, at a first temperature, a layer of material to an iron nitride-containing workpiece including at least one $Fe_{16}N_2$ phase domain, such that an interface is formed between the layer and the iron nitride-containing workpiece, where the material has a different coefficient of thermal expansion than the iron nitride-containing workpiece; and bringing the iron nitride-containing workpiece and the layer of material from the first temperature to a second temperature different than the first temperature to cause at least one of a compressive force or a tensile force on the iron nitride-containing workpiece, where the at least one of the compressive force or the tensile force preserves strain in at least the portion of the iron nitride-containing workpiece including the at least one $Fe_{16}N_2$ phase domain.

In another aspect, the disclosure is directed to an article that includes an iron nitride-containing workpiece including at least one $Fe_{16}N_2$ phase domain; and a layer of material that covers at least a portion of an outer surface of the iron nitride-containing workpiece, where the material has a different coefficient of thermal expansion than the iron nitride containing workpiece, and wherein the layer of material exerts at least one of a tensile force or a compressive force on the iron nitride-containing workpiece in at least a direction parallel to an interface between the layer of material and the iron nitride-containing workpiece.

The details of one or more examples of the disclosure are set forth in the accompanying drawings and the description below. Other features, objects, and advantages of the disclosure will be apparent from the description and drawings, and from the claims.

DETAILED DESCRIPTION

In general, the disclosure is directed to permanent magnets that include a $Fe_{16}N_2$ phase constitution and techniques for forming permanent magnets that include a $Fe_{16}N_2$ phase constitution. In particular, the techniques described herein are used to form bulk phase $Fe_{16}N_2$ permanent magnets.

$Fe_{16}N_2$ permanent magnets may provide a relatively high energy product, for example, as high as about 134 MGOe when the $Fe_{16}N_2$ permanent magnet is anisotropic. In examples in which the $Fe_{16}N_2$ magnet is isotropic, the energy product may be as high as about 33.5 MGOe. The energy product of a permanent magnet is proportional to the product of remnant coercivity and remnant magnetization. For comparison, the energy product of $Nd_2Fe_{14}B$ permanent magnet may be as high as about 60 MGOe. A higher energy product can lead to increased efficiency of the permanent magnet when used in motors, generators, or the like.

Figure 1:
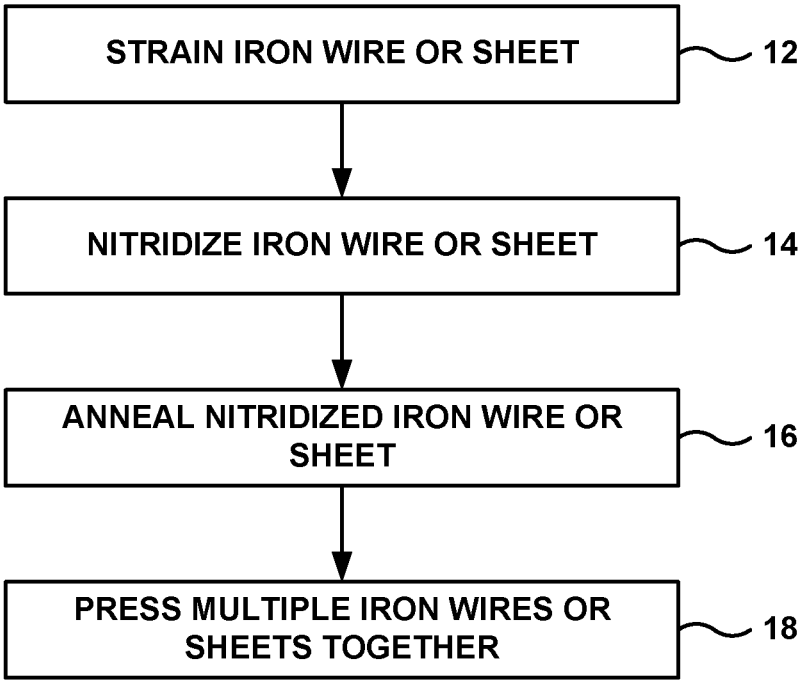
FIG. 1 is a flow diagram that illustrates an example technique for forming a bulk $Fe_{16}N_2$ permanent magnet.
Figure 2:
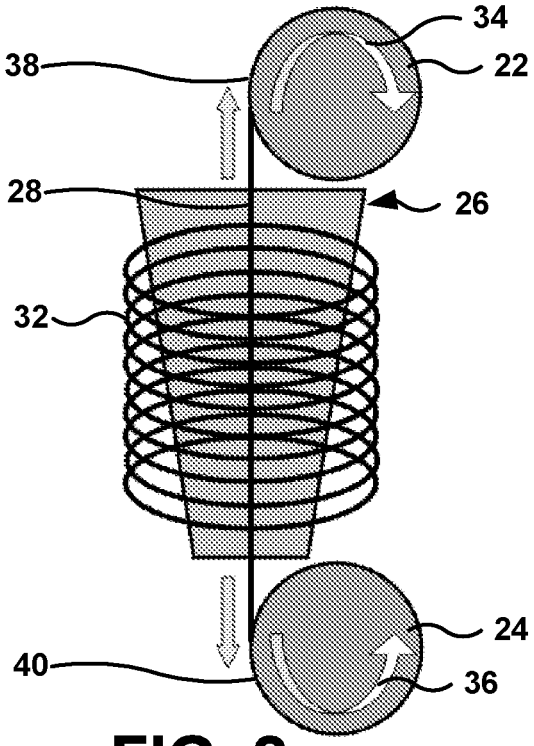
FIG. 2 is a conceptual diagram illustrating an example apparatus with which an iron wire or sheet can be strained and exposed to nitrogen.
Figure 3:
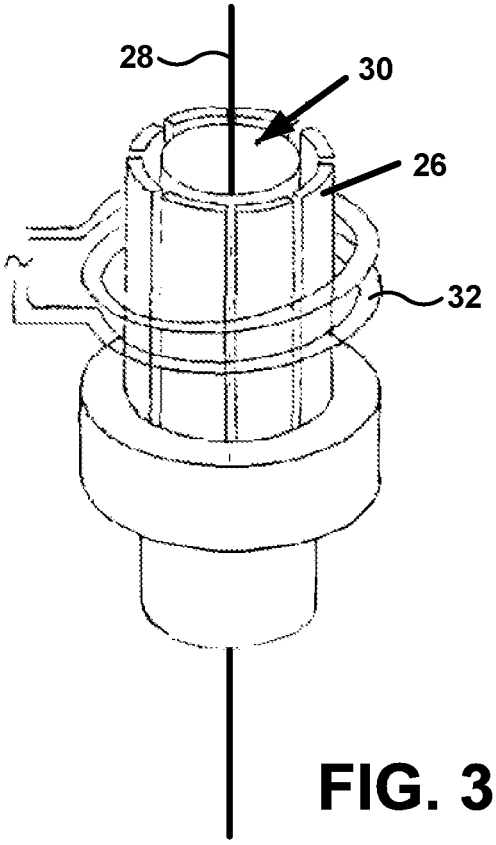
FIG. 3 illustrates further detail of one example of the Crucible heating stage shown in FIG. 2.

FIG. 1 is a flow diagram that illustrates an example technique for forming a bulk $Fe_{16}N_2$ permanent magnet. The technique of FIG. 1 will be described with concurrent reference to FIGS. 2-5. FIG. 2 illustrates a conceptual diagram of an apparatus with which the iron wire or sheet can be strained and exposed to nitrogen. FIG. 3 illustrates further detail of one example of the Crucible heating stage shown in FIG. 2.

The example apparatus of FIG. 2 includes a first roller 22, a second roller 24, and a Crucible heating stage 26. First roller 22 and second roller 24 are configured to receive a first end 38 and a second end 40, respectively, of an iron wire or sheet 28. Iron wire or sheet 28 defines a major axis between first end 38 and second end 40. As best seen in FIG. 3, iron wire or sheet 28 passes through an aperture 30 defined by Crucible heating stage 26. Crucible heating stage 26 includes an inductor 32 that surrounds at least a portion of the aperture 30 defined by Crucible heating stage 26.

The example technique of FIG. 1 includes straining iron wire or sheet 28 along a direction substantially parallel (e.g., parallel or nearly parallel) to a <001> axis of at least one iron crystal in the iron wire or sheet 28 (12). In some examples, iron wire or sheet 28 is formed of iron having a body centered cubic (bcc) crystal structure.

In some examples, iron wire or sheet 28 is formed of a single bcc crystal structure. In other examples, iron wire or sheet 28 may be formed of a plurality of bcc iron crystals. In some of these examples, the plurality of iron crystals are oriented such that at least some, e.g., a majority or substantially all, of the <001> axes of individual unit cells and/or crystals are substantially parallel to the direction in which strain is applied to iron wire or sheet 28. For example, when the iron is formed as iron wire or sheet 28, at least some of the <001> axes may be substantially parallel to the major axis of the iron wire or sheet 28, as shown in FIGS. 2 and 3. As noted above, in some examples, single crystal iron nitride wires and sheets may be formed using Crucible techniques. In addition to such Crucible techniques, single crystal iron wires and sheets may be formed by either the micro melt zone floating or pulling from a micro shaper to form iron wire or sheet 28.

Figure 13:
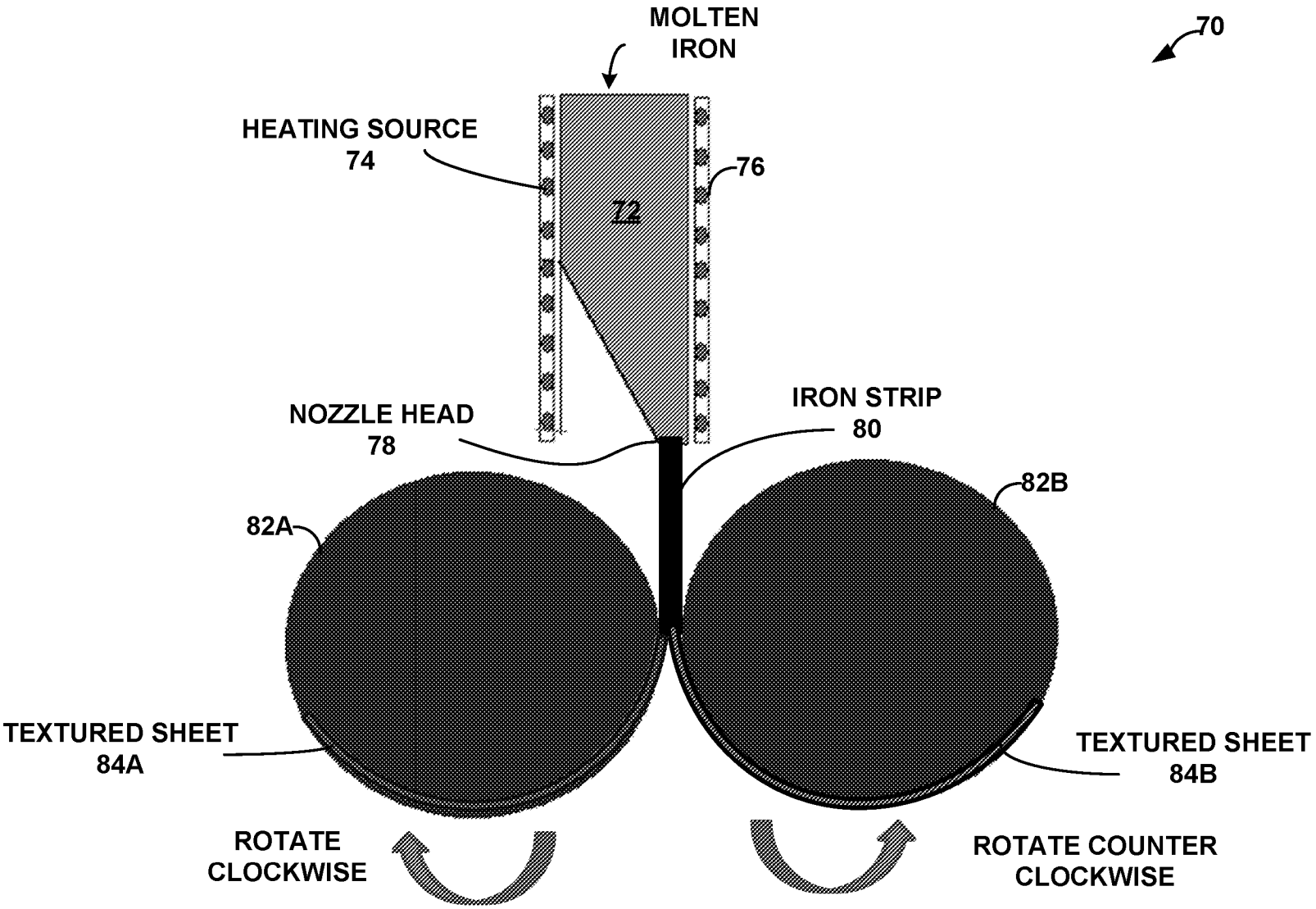
FIG. 13 is a conceptual diagram illustrating an example apparatus for fast belt casting to texture an example iron nitride wire or sheet.

In some examples, iron wire or sheet 28 may have a crystalline textured structure. Techniques may be used to form crystalline textured (e.g., with desired crystalline orientation along the certain direction of wires and sheets) iron wires or sheet 28. FIG. 13 is a conceptual diagram illustrating one example apparatus 70 for fast belt casting to texture an example iron wire or sheet, such as iron wire or sheet 28. As shown fast belt casting apparatus 70 includes ingot chamber 76 which contains molten iron ingot 72, which may be heated by heating source 74, e.g., in the form of a heating coil. Ingot 72 flow out of chamber 76 through nozzle head 78 to form iron strip 80. Iron strip 80 is fed into the gap zone between surface of pinch rollers 82A and 82B, which are rotated in opposite directions. In some examples, the rotation of roller 82A and 82B may vary from approximately 10 to 1000 rotations per minute. Iron strip cools on pinch rollers 82A and 82B and, after being pressed between pinch rollers 82A and 82B, forms textured iron strips 84A and 84B. In some examples, textured iron strips 84A and 84B may form textured iron ribbon with thickness between, e.g., about one micrometer and about a millimeter (either individually or after compression of multiple iron strips).

Figure 4:
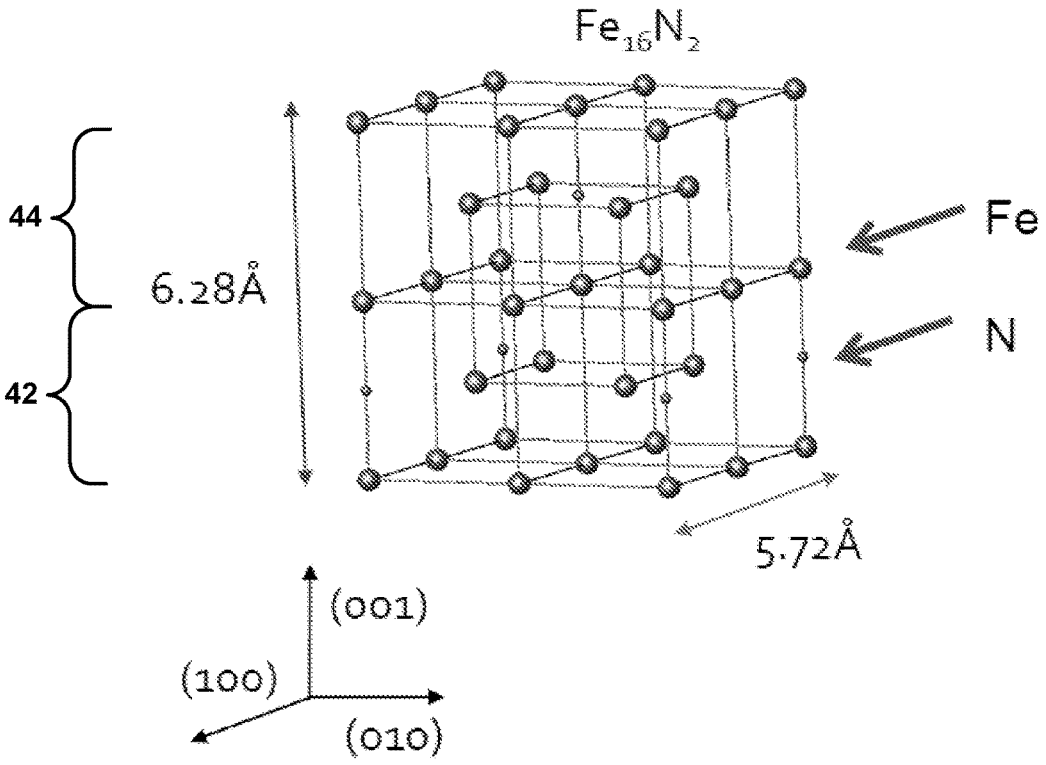
FIG. 4 is a conceptual diagram that shows eight (8) iron unit cells in a strained state with nitrogen atoms implanted in interstitial spaces between iron atoms.

In an unstrained iron bcc crystal lattice, the <100>, <010>, and <001> axes of the crystal unit cell may have substantially equal lengths. However, when a force, e.g., a tensile force, is applied to the crystal unit cell in a direction substantially parallel to one of the crystal axes, e.g., the <001> crystal axis, the unit cell may distort and the iron crystal structure may be referred to as body centered tetragonal (bct). For example, FIG. 4 is a conceptual diagram that shows eight (8) iron unit cells in a strained state with nitrogen atoms implanted in interstitial spaces between iron atoms. The example in FIG. 4 includes four iron unit cells in a first layer 42 and four iron unit cells in a second layer 44. Second layer 44 overlays first layer 42 and the unit cells in second layer 44 are substantially aligned with the unit cells in first layer 42 (e.g., the <001> crystal axes of the unit cells are substantially aligned between the layers). As shown in FIG. 4, the iron unit cells are distorted such that the length of the unit cell along the <001> axis is approximately 3.14 angstroms (Å) while the length of the unit cell along the <010> and <100> axes is approximately 2.86 Å. The iron unit cell may be referred to as a bct unit cell when in the strained state. When the iron unit cell is in the strained state, the <001> axis may be referred to as the c-axis of the unit cell.

The strain may be exerted on iron wire or sheet 28 using a variety of strain inducing apparatuses. For example, as shown in FIG. 2, first end 38 and second end 40 of iron wire or sheet 28 may received by (e.g., wound around) first roller 22 and second roller 24, respectively, and rollers 22, 24 may be rotated in opposite directions (indicated by arrows 34 and 35 in FIG. 2) to exert a tensile force on the iron wire or sheet 28.

Figure 6:
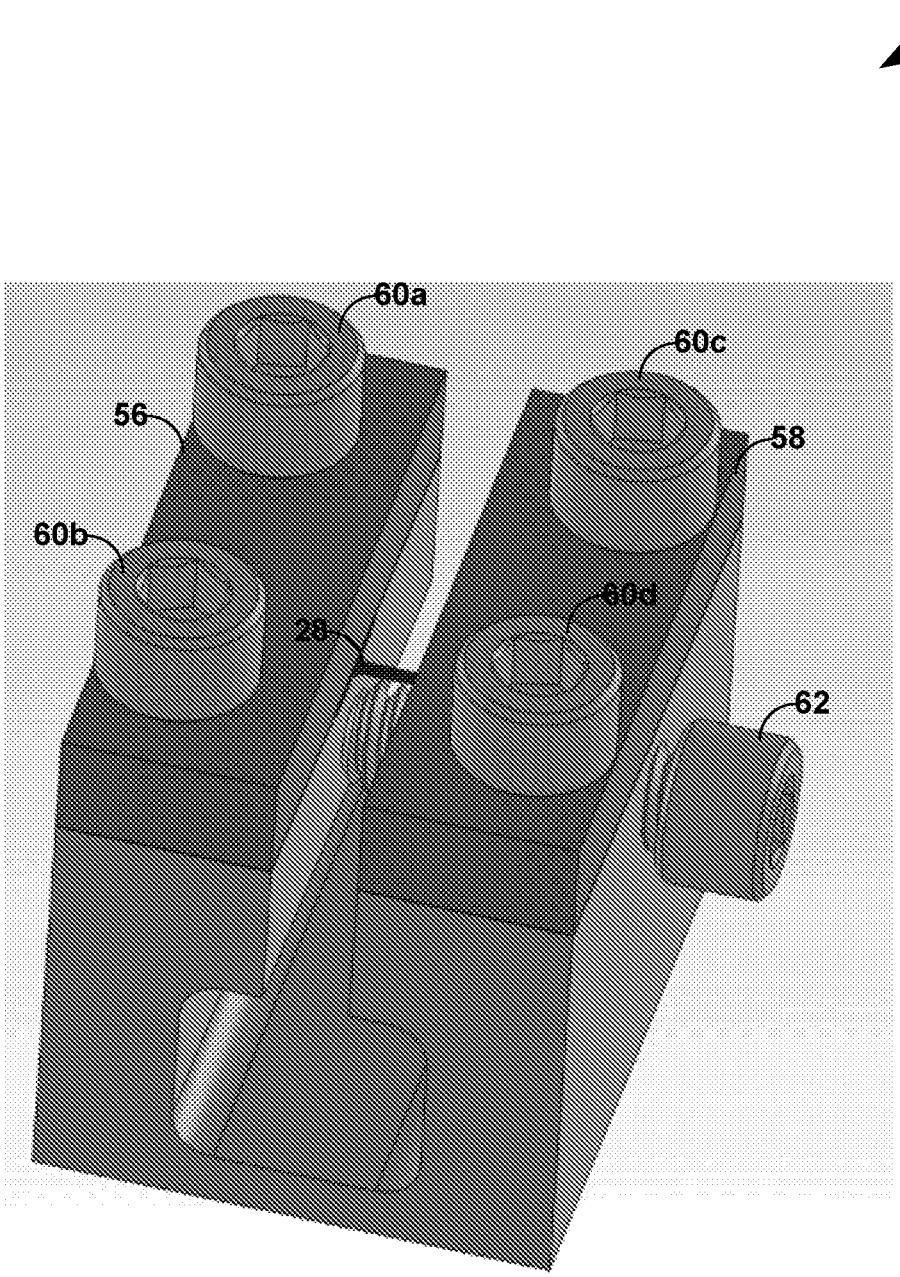
FIG. 6 is a conceptual diagram illustrating another example apparatus with which an iron wire or sheet can be strained.

In other examples, opposite ends of iron wire or sheet 28 may be gripped in mechanical grips, e.g., clamps, and the mechanical grips may be moved away from each other to exert a tensile force on the iron wire or sheet 28. FIG. 6 is a conceptual diagram illustrating another example apparatus with which iron wire or sheet 28 can be strained as described herein. As shown, apparatus 54 includes clamps 56 and 58 which may secure opposing ends of iron wire or sheet 28 by tightening screws 60*a-d*. Once iron wire or sheet is secured in apparatus 19, bolt 62 may be turned to rotate the threaded body of bolt 62 to increase the distance between clamps 56 and 58 and exert a tensile force on iron wire or sheet 28. The value of the elongation or stress generated by the rotation of bolt 62 may be measured by any suitable gauge, such as, e.g., a strain gauge. In some examples, apparatus 54 may be placed in a furnace (e.g., a tube furnace) or other heated environment so that iron wire or sheet 28 may be heated during and/or after iron wire or sheet 28 is stretched by apparatus 54.

A strain inducing apparatus may strain iron wire or sheet 28 to a certain elongation. For example, the strain on iron wire or sheet 28 may be between about 0.3% and about 7%. In other examples, the strain on iron wire or sheet 28 may be less than about 0.3% or greater than about 7%. In some examples, exerting a certain strain on iron wire or sheet 28 may result in a substantially similar strain on individual unit cells of the iron, such that the unit cell is elongated along the <001> axis between about 0.3% and about 7%.

Iron wire or sheet 28 may have any suitable diameter and/or thickness. In some examples, a suitable diameter and/or thickness may be on the order of micrometers (μm) or millimeters (mm). For example, an iron wire may have a diameter greater than about 10 μm (0.01 mm). In some examples, the iron wire has a diameter between about 0.01 mm and about 1 mm, such as about 0.1 mm. Similarly, an iron sheet may have any suitable thickness and/or width. In some examples, the iron sheet may have a thickness greater than about 0.01 mm, such as between about 0.01 mm and about 1 mm, or about 0.1 mm. In some implementations, a width of the iron sheet may be greater than a thickness of the iron sheet.

A diameter of the iron wire or cross-sectional area of the iron sheet (in a plane substantially orthogonal to the direction in which the iron sheet is stretched/strained) may affect an amount of force that must be applied to iron wire or sheet 28 to result in a given strain. For example, the application of approximately 144 N of force to an iron wire with a diameter of about 0.1 mm may result in about a 7% strain. As another example, the application of approximately 576 N of force to an iron wire with a diameter of about 0.2 mm may result in about a 7% strain. As another example, the application of approximately 1296 N of force to an iron wire with a diameter of about 0.3 mm may result in about a 7% strain. As another example, the application of approximately 2304 N of force to an iron wire with a diameter of about 0.4 mm may result in about a 7% strain. As another example, the application of approximately 3600 N of force to an iron wire with a diameter of about 0.5 mm may result in about a 7% strain.

In some examples, iron wire or sheet 28 may include dopant elements which serve to stabilize the $Fe_{16}N_2$ phase constitution once the $F_{e16}N_2$ phase constitution has been formed. For example, the phase stabilization dopant elements may include cobalt (Co), titanium (Ti), chromium (Cr), copper (Cu), zinc (Zn), or the like.

As the strain inducing apparatus exerts the strain on iron wire or sheet 28 and/or once the strain inducing apparatus is exerting a substantially constant strain on the iron wire or sheet 28, iron wire or sheet 28 may be nitridized (14). In some examples, during the nitridization process, iron wire or sheet 28 may be heated using a heating apparatus. One example of a heating apparatus that can be used to heat iron wire or sheet 28 is Crucible heating stage 26, shown in FIGS. 2 and 3.

Crucible heating stage 26 defines aperture 30 through which iron wire or sheet 28 passes (e.g., in which a portion of iron wire or sheet 28 is disposed). In some examples, no portion of Crucible heating stage 26 contacts iron wire or sheet 28 during the heating of iron wire or sheet 28. In some implementations, this is advantageous as it lower a risk of unwanted elements or chemical species contacting and diffusing into iron wire or sheet 28. Unwanted elements or chemical species may affect properties of iron wire or sheet 28; thus, it may be desirable to reduce or limit contact between iron wire or sheet 28 and other materials.

Crucible heating stage 26 also includes an inductor 32 that surrounds at least a portion of aperture 30 defined by Crucible heating stage 26. Inductor 32 includes an electrically conductive material, such as aluminum, silver, or copper, through which an electric current may be passed. The electric current may be an alternating current (AC), which may induce eddy currents in iron wire or sheet 28 and heat the iron wire or sheet 28. In other examples, instead of using Crucible heating stage 26 to heat iron wire or sheet 28, other non-contact heating sources may be used. For example, a radiation heat source, such as an infrared heat lamp, may be used to heat iron wire or sheet 28. As another example, a plasma arc lamp may be used to heat iron wire or sheet 28.

Regardless of the heating apparatus used to heat iron wire or sheet 28 during the nitridizing process, the heating apparatus may heat iron wire or sheet 28 to temperature for a time sufficient to allow diffusion of nitrogen to a predetermined concentration substantially throughout the thickness or diameter of iron wire or sheet 28. In this manner, the heating time and temperature are related, and may also be affected by the composition and/or geometry of iron wire or sheet 28. For example, iron wire or sheet 28 may be heated to a temperature between about 125° C. and about 600° C. for between about 2 hours and about 9 hours. In some examples, iron wire or sheet 28 may be heated to a temperature between about 500° C. and about 600° C. for between about 2 hours and about 4 hours.

In some examples, iron wire or sheet 28 includes an iron wire with a diameter of about 0.1 mm. In some of these examples, iron wire or sheet 28 may be heated to a temperature of about 125° C. for about 8.85 hours or a temperature of about 600° C. for about 2.4 hours. In general, at a given temperature, the nitridizing process time may be inversely proportional to a characteristic dimension squared of iron wire or sheet 28, such as a diameter of an iron wire or a thickness of an iron sheet.

In addition to heating iron wire or sheet 28, nitridizing iron wire or sheet 28 (14) includes exposing iron wire or sheet 28 to an atomic nitrogen substance, which diffuses into iron wire or sheet 28. In some examples, the atomic nitrogen substance may be supplied as diatomic nitrogen ($N_2$), which is then separated (cracked) into individual nitrogen atoms. In other examples, the atomic nitrogen may be provided from another atomic nitrogen precursor, such as ammonia ($NH_3$), an amine, or ammonium nitrate ($NH_4NO_3$). In other examples, the atomic nitrogen may be provided from urea ($CO(NH_2)_2$).

The nitrogen may be supplied in a gas phase alone (e.g., substantially pure ammonia or diatomic nitrogen gas) or as a mixture with a carrier gas. In some examples, the carrier gas is argon (Ar). The gas or gas mixture may be provided at any suitable pressure, such as between about 0.001 Torr (about 0.133 pascals (Pa)) and about 10 Torr (about 1333 Pa), such as between about 0.01 Torr (about 1.33 Pa) and about 0.1 Torr (about 13.33 Torr). In some examples, when the nitrogen is delivered as part of a mixture with a carrier gas, the partial pressure of nitrogen or the nitrogen precursor (e.g., $NH_3$) may be between about 0.02 and about 0.1.

The nitrogen precursor (e.g., $N_2$ or $NH_3$) may be cracked to form atomic nitrogen substances using a variety of techniques. For example, the nitrogen precursor may be heated using radiation to crack the nitrogen precursor to form atomic nitrogen substances and/or promote reaction between the nitrogen precursor and iron wire or sheet 28. As another example, a plasma arc lamp may be used to split the nitrogen precursor to form atomic nitrogen substances and/or promote reaction between the nitrogen precursor and iron wire or sheet 28.

In some examples, iron wire or sheet 28 may be nitridized (14) via a urea diffusion process, in which urea is utilized as a nitrogen source (e.g., rather than diatomic nitrogen or ammonia). Urea (also referred to as carbamide) is an organic compound with the chemical formula $CO(NH_2)_2$ that may be used in some cases as a nitrogen release fertilizer. To nitridize iron wire or sheet 28 (14), urea may heated, e.g., within a furnace with iron wire or sheet 28, to generate decomposed nitrogen atoms which may diffuse into iron wire or sheet 28. As will be described further below, the constitution of the resulting nitridized iron material may be controlled to some extent by the temperature of the diffusion process as well as the ratio (e.g., the weight ratio) of iron to urea used for the process. In other examples, iron wire or sheet 28 may be nitridized by an implantation process similar to that used in semiconductor processes for introducing doping agents.

Figure 7:
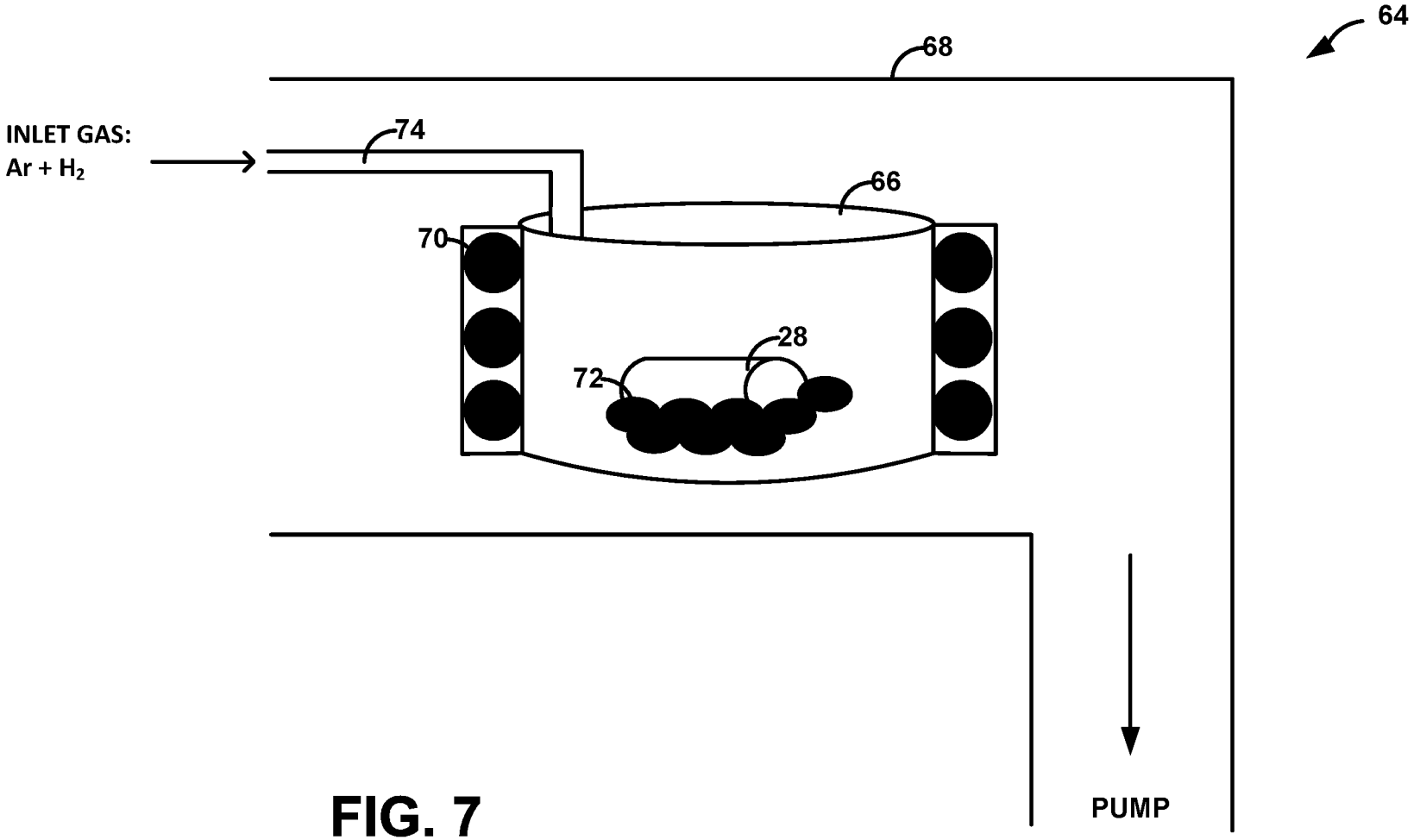
FIG. 7 is a schematic diagram illustrating an example apparatus that may be used for nitriding an iron wire or sheet via a urea diffusion process.

FIG. 7 is a schematic diagram illustrating an example apparatus 64 that may be used for nitriding iron wire or sheet 28 via a urea diffusion process. Such a urea diffusion process may be used to nitride iron wire or sheet 28, e.g., when having a single crystal iron, a plurality of crystal structure, or textured structure. Moreover, iron materials with different shapes, such as wire, sheet or bulk, can also be diffused using such a process. For wire material, the wire diameter may be varied, e.g., from several micrometers to millimeters. For sheet material, the sheet thickness may be from, e.g., several nanometers to millimeters. For bulk material, the material weight may be from, e.g., about 1 milligram to kilograms.

As shown, apparatus 64 includes crucible 66 within vacuum furnace 68. Iron wire or sheet 28 is located within crucible 66 along with the nitrogen source of urea 72. As shown in FIG. 7, a carrier gas including Ar and hydrogen is fed into crucible 66 during the urea diffusion process. In other examples, a different carrier gas or even no carrier gas may be used. In some examples, the gas flow rate within vacuum furnace 68 during the urea diffusion process may be between approximately 5 standard cubic centimeters per minute (sccm) to approximately 50 sccm, such as, e.g., 20 standard cubic centimeters per minute (sccm) to approximately 50 sccm or 5 standard cubic centimeters per minute (sccm) to approximately 20 sccm.

Heating coils 70 may heat iron wire or sheet 28 and urea 72 during the urea diffusion process using any suitable technique, such as, e.g., eddy current, inductive current, radio frequency, and the like. Crucible 66 may be configured to withstand the temperature used during the urea diffusion process. In some examples, crucible 66 may be able to withstand temperatures up to approximately 1600° C.

Urea 72 may be heated with iron wire or sheet 28 to generate nitrogen that may diffuse into iron wire or sheet 28 to form an iron nitride material. In some examples, urea 72 and iron wire or sheet 28 may heated to approximately 650° C. or greater within crucible 66 followed by cooling to quench the iron and nitrogen mixture to form an iron nitride material having a $Fe_{16}N_2$ phase constitution substantially throughout the thickness or diameter of iron wire or sheet 28. In some examples, urea 72 and iron wire or sheet 28 may heated to approximately 650° C. or greater within crucible 66 for between approximately 5 minutes to approximately 1 hour. In some examples, urea 72 and iron wire or sheet 28 may be heated to between approximately 1000° C. to approximately 1500° C. for several minutes to approximately an hour. The time of heating may depend on the diffusion coefficient of nitrogen in iron at different temperatures. For example, if the iron wire or sheet is thickness is about 1 micrometer, the diffusion process may be finished in about 5 minutes at about 1200° C., about 12 minutes at 1100° C., and so forth.

To cool the heated material during the quenching process, cold water may be circulated outside the crucible to rapidly cool the contents. In some examples, the temperature may be decreased from 650° C. to room temperature in about 20 seconds.

As will be described below, in some examples, the temperature of urea 72 and iron wire or sheet 28 may be between, e.g., approximately 200° C. and approximately 150° C. to anneal the iron and nitrogen mixture to form an iron nitride material having a $Fe_{16}N_2$ phase constitution substantially throughout the thickness or diameter of iron wire or sheet 28. Urea 72 and iron wire or sheet 28 may be at the annealing temperature, e.g., between approximately 1 hour and approximately 40 hours. Such an annealing process could be used in addition to or as an alternative to other nitrogen diffusion techniques, e.g., when the iron material is single crystal iron wire and sheet, or textured iron wire and sheet with thickness in micrometer level. In each of annealing and quenching, nitrogen may diffuse into iron wire or sheet 28 from the nitrogen gas or gas mixture including Ar plus hydrogen carrier gas within furnace 68. In some examples, gas mixture may have a composition of approximately 86% Ar+4% $H_2$+10% $N_2$. In other examples, the gas mixture may have a composition of 10% $N_2$+90% Ar or 100% $N_2$ or 100% Ar.

As will be described further below, the constitution of the iron nitride material formed via the urea diffusion process may be dependent on the weight ratio of urea to iron used. As such, in some examples, the weight ratio of urea to iron may be selected to form an iron nitride material having a $Fe_{16}N_2$ phase constitution. However, such a urea diffusion process may be used to form iron nitride materials other than that having a $Fe_{16}N_2$ phase constitution, such as, e.g., $Fe_2N$, $Fe_3N$, $Fe_4N$, $Fe_8N$, and the like. Moreover, the urea diffusion process may be used to diffuse nitrogen into materials other than iron. For example, such an urea diffusion process may be used to diffuse nitrogen into there are Indium, FeCo, FePt, CoPt, Cobalt, Zn, Mn, and the like.

Regardless of the technique used to nitridize iron wire or sheet 28 (14), the nitrogen may be diffused into iron wire or sheet 28 to a concentration of about 8 atomic percent (at. %) to about 14 at. %, such as about 11 at. %. The concentration of nitrogen in iron may be an average concentration, and may vary throughout the volume of iron wire or sheet 28. In some examples, the resulting phase constitution of at least a portion of the nitridized iron wire or sheet 28 (after nidtridizing iron wire or sheet 28 (14)) may be α' phase $Fe_8N$. The $Fe_8N$ phase constitution is the chemically disordered counterpart of chemically-ordered $Fe_{16}N_2$ phase. A $Fe_8N$ phase constitution also has a bct crystal cell, and can introduce a relatively high magnetocrystalline anisotropy.

Figure 8:
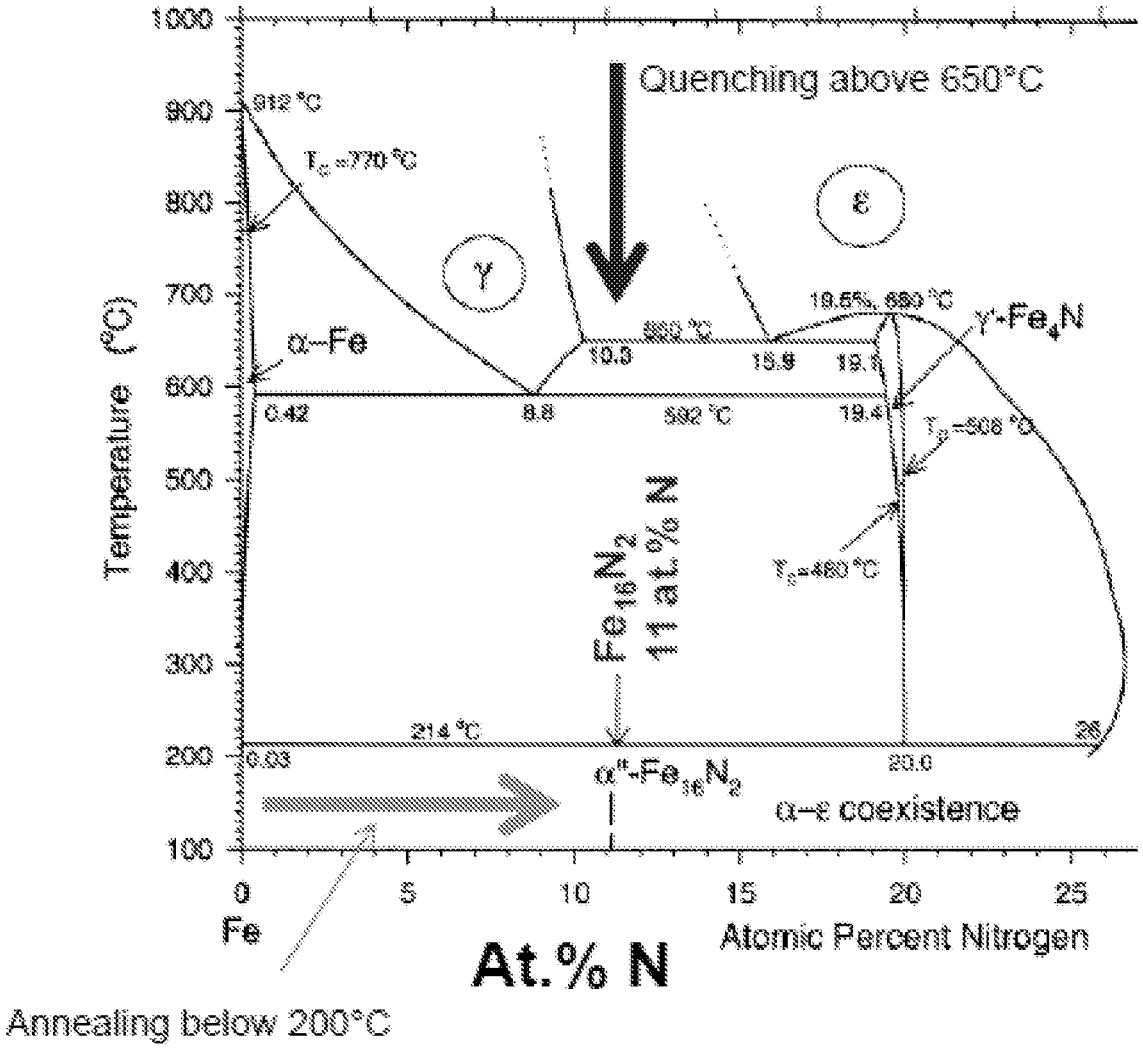
FIG. 8 is an iron nitride phase diagram.

In some examples, the nitridized iron wire or sheet 28 may be α" phase $Fe_{16}N_2$. FIG. 8 is an iron nitrogen phase diagram. As indicated in FIG. 8, at an atomic percent of approximately 11 at. % N, α" phase $Fe_{16}N_2$ may be formed by quenching an Fe—N mixture at a temperature above approximately 650° C. for a suitable amount of time. Additionally, at an atomic percent of approximately 11 at. % N, α" phase $Fe_{16}N_2$ may be formed by annealing an Fe—N mixture at a temperature below approximately 200° C. for a suitable amount of time.

In some examples, once iron wire or sheet 28 has been nitridized (14), iron wire or sheet 28 may be annealed at a temperature for a time to facilitate diffusion of the nitrogen atoms into appropriate interstitial spaces within the iron lattice to form $Fe_{16}N_2$ (16). FIG. 4 illustrates an example of the appropriate interstitial spaces of the iron crystal lattice in which nitrogen atoms are positioned. In some examples, the nitridized iron wire or sheet 28 may be annealed at a temperature between about 100° C. and about 300° C. In other examples, the annealing temperature may be about 126.85° C. (about 400 Kelvin). The nitridized iron wire or sheet 28 may be annealed using Crucible heating stage 26, a plasma arc lamp, a radiation heat source, such as an infrared heat lamp, an oven, or a closed retort.

The annealing process may continue for a predetermined time that is sufficient to allow diffusion of the nitrogen atoms to the appropriate interstitial spaces. In some examples, the annealing process continues for between about 20 hours and about 100 hours, such as between about 40 hours and about 60 hours. In some examples, the annealing process may occur under an inert atmosphere, such as Ar, to reduce or substantially prevent oxidation of the iron. In some implementations, while iron wire or sheet 28 is annealed (16) the temperature is held substantially constant.

Once the annealing process has been completed, iron wire or sheet 28 may include a $Fe_{16}N_2$ phase constitution. In some examples, at least a portion of iron wire or sheet 28 consists essentially of a $Fe_{16}N_2$ phase constitution. As used herein "consists essentially of" means that the iron wire or sheet 28 includes $Fe_{16}N_2$ and other materials that do not materially affect the basic and novel characteristics of the $Fe_{16}N_2$ phase. In other examples, iron wire or sheet 28 may include a $Fe_{16}N_2$ phase constitution and a $Fe_8N$ phase constitution, e.g., in different portions of iron wire or sheet 28. $Fe_8N$ phase constitution and $Fe_{16}N_2$ phase constitution in the wires and sheets and the later their pressed assemble may exchange-couple together magnetically through a working principle of quantum mechanics. This may form a so-called exchange-spring magnet, which may increase the magnetic energy product even just with a small portion of $Fe_{16}N_2$.

In some examples, as described in further detail below, iron wire or sheet 28 may include dopant elements or defects that serve as magnetic domain wall pinning sites, which may increase coercivity of iron wire or sheet 28. As used herein, an iron wire or sheet 28 that consists essentially of $Fe_{16}N_2$ phase constitution may include dopants or defects that serve as domain wall pinning sites. In other examples, as described in further detail below, iron wire or sheet 28 may include non-magnetic dopant elements that serve as grain boundaries, which may increase coercivity of iron wire or sheet. As used herein, an iron wire or sheet 28 that consists of $Fe_{16}N_2$ phase constitution may include non-magnetic elements that serve as grain boundaries.

Once the annealing process has been completed, iron wire or sheet 28 may be cooled under an inert atmosphere, such as argon, to reduce or prevent oxidation.

In some examples, iron wire or sheet 28 may not be κ sufficient size for the desired application. In such examples, multiple iron wire or sheets 28 may be formed (each including or consisting essentially of a $Fe_{16}N_2$ phase constitution) and the multiple iron wire or sheets 28 may be pressed together to form a larger permanent magnet that includes or consists essentially of a $Fe_{16}N_2$ phase constitution (18).

Figures 5A, 5B:
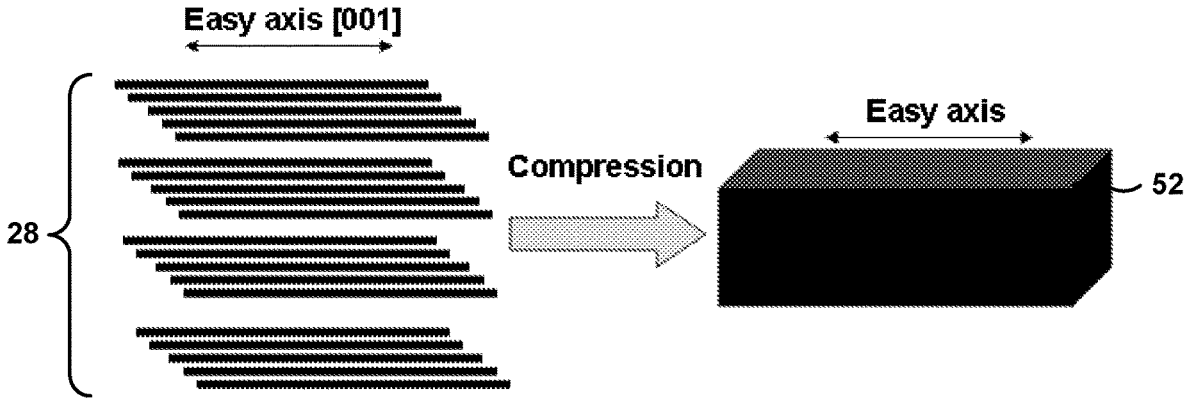
FIGS. 5A and 5B are conceptual diagrams that illustrate an example of the compression process for combining multiple iron wires or sheets into a permanent magnet.

FIGS. 5A and 5B are conceptual diagrams that illustrate an example of the compression process. As shown in FIG. 5A, multiple iron wire or sheets 28 are arranged such that the <001> axes of the respective iron wire or sheets 28 are substantially aligned. In examples in which the <001> axes of the respective iron wire or sheets 28 are substantially parallel to a long axis of the wire or sheet 28, substantially aligning the iron wire or sheets 28 may include overlying one iron wire or sheet 28 on another iron wire or sheet 28. Aligning the <001> axes of the respective iron wires or sheets 28 may provide uniaxial magnetic anisotropy to permanent magnet 52.

The multiple iron wires or sheets 28 may be compressed using, for example, cold compression or hot compression. In some examples, the temperature at which the compression is performed may be below about 300° C., as $Fe_{16}N_2$ may begin to degrade above about 300° C. The compression may be performed at a pressure and for a time sufficient to join the multiple iron wires or sheets 28 into a substantially unitary permanent magnet 52, as shown in FIG. 5B.

Any number of iron wires or sheets 28 may be pressed together to form permanent magnet 52. In some examples, permanent magnet 52 has a size in at least one dimension of at least 0.1 mm. In some examples, permanent magnet 52 has a size in at least one dimension of at least 1 mm. In some examples, permanent magnet 52 has a size in at least one dimension of at least 1 cm.

In some examples, in order to provide desirable high coercivity, it may be desirable to control magnetic domain movement within iron wire or sheet 28 and/or permanent magnet 52. One way in which magnetic domain movement may be controlled is through introduction of magnetic domain wall pinning sites into iron wire or sheet 28 and/or permanent magnet 52. In some examples, magnetic domain wall pinning sites may be formed by introducing defects into the iron crystal lattice. The defects may be introduced by injecting a dopant element into the iron crystal lattice or through mechanical stress of the iron crystal lattice. In some examples, the defects may be introduced into the iron crystal lattice before introduction of nitrogen and formation of the $Fe_{16}N_2$ phase constitution. In other examples, the defects may be introduced after annealing iron wire or sheet 28 to form $Fe_{16}N_2$ (16). One example by which defects that serve as domain wall pinning sites may be introduced into iron wire or sheet 28 may be ion bombardment of boron (B), copper (Cu), carbon (C), silicon (Si), or the like, into the iron crystal lattice. In other examples, powders consisting of non magnetic elements or compounds (e.g. Cu, Ti, Zr, Cr, Ta, $SiO_2$, $Al_2O_3$, etc) may be pressed together with the iron wires and sheets that include a $Fe_{16}N_2$ phase. Those non magnetic powders, with the size ranging from several nanometers to several hundred nanometers, function as the grain boundaries for the $Fe_{16}N_2$ phase after pressing process. These grain boundaries may enhance the coercivity of the permanent magnet.

Although described with regard to iron nitride, one or more of the example processes described herein may also apply to FeCo alloy to form single crystal or highly textured FeCo wires and sheets. Co atoms may replace part of Fe atoms in Fe lattice to enhance the magnetocrystalline anisotropy. Additionally, one or more of the example strained diffusion processes described herein may also apply to these FeCo wires and sheets. Furthermore, one or more of the examples processes may also apply to diffuse Carbon (C), Boron (B) and Phosphorus (P) atoms into Fe or FeCo wires and sheets, or partially diffuse C, P, B into Fe or FeCo wires and sheets together with N atoms. Accordingly, the methods described herein may also apply to FeCo alloy to form single crystal or highly textured FeCo wires and sheets. Also, Co atoms may replace part of Fe atoms in Fe lattice, e.g., to enhance the magnetocrystalline anisotropy. Further, the method described herein may also apply to diffuse Carbon (C), Boron (B) and Phosphorus (P) atoms into Fe or FeCo wires and sheets, or partially diffuse C, P, B into Fe or FeCo wires and sheets together with N atoms. Moreover, the iron used for the processes described herein may take the shape of wire, sheet, or bulk form. Further, in some examples, the iron used for the processes may be described as a workpiece that takes any one of a number of shapes, such as a wire, rod, bar, conduit, hollow conduit, film, thin film, sheet, fiber, ribbon, bulk material, ingot, or the like. Example shapes of iron, including workpieces, may have a variety of cross-sectional shapes and sizes, and contain any combination of the types of shapes described herein.

As described above, the disclosure describes magnetic materials that include an $\alpha''$-$Fe_{16}N_2$ phase constitution and techniques for forming and preserving an $\alpha''$-$Fe_{16}N_2$ phase constitution in the magnetic materials. In some examples, the techniques described herein are used to preserve strain in a detwinned martensite $\alpha''$-$Fe_{16}N_2$ phase in thin film, nanoparticle, workpiece, or bulk magnetic materials. The disclosed strain preservation techniques may preserve or enhance $\alpha''$-$Fe_{16}N_2$ phase stability which may preserve or enhance, for example, at least one of coercivity, magnetization, magnetic orientation, or energy product of magnetic materials including an $\alpha''$-$Fe_{16}N_2$ phase.

In some examples, techniques for preserving strain in an iron nitride-containing workpiece include forming a predetermined crystallographic texture in the material. Crystallographic texture is a phenomenon in which multiple crystals within a material share a substantially common crystallographic orientation. Crystallographic texture may help preserve strain in an iron nitride-containing workpiece, which may preserve $\alpha''$-$Fe_{16}N_2$ phase domains within the iron nitride-containing workpiece. Alternatively or additionally, crystallographic texture may facilitate formation of deformed (or detwinned) $\alpha''$-$Fe_{16}N_2$.

Crystallographic texture may be formed by one or more selected techniques. For example, straining an iron nitride-containing workpiece along one or more axes may facilitate formation of crystallographic texture. In some examples, a tensile force may be applied along a first axis of a workpiece, and a compressive force may be applied along at least a second axis of the workpiece, substantially orthogonal to the first axis of the workpiece. Other techniques for introducing crystallographic texture include magnetically agitating a molten iron nitride mixture during mixing of the iron and nitrogen, etching an iron nitride material, or the like.

Figure 14:
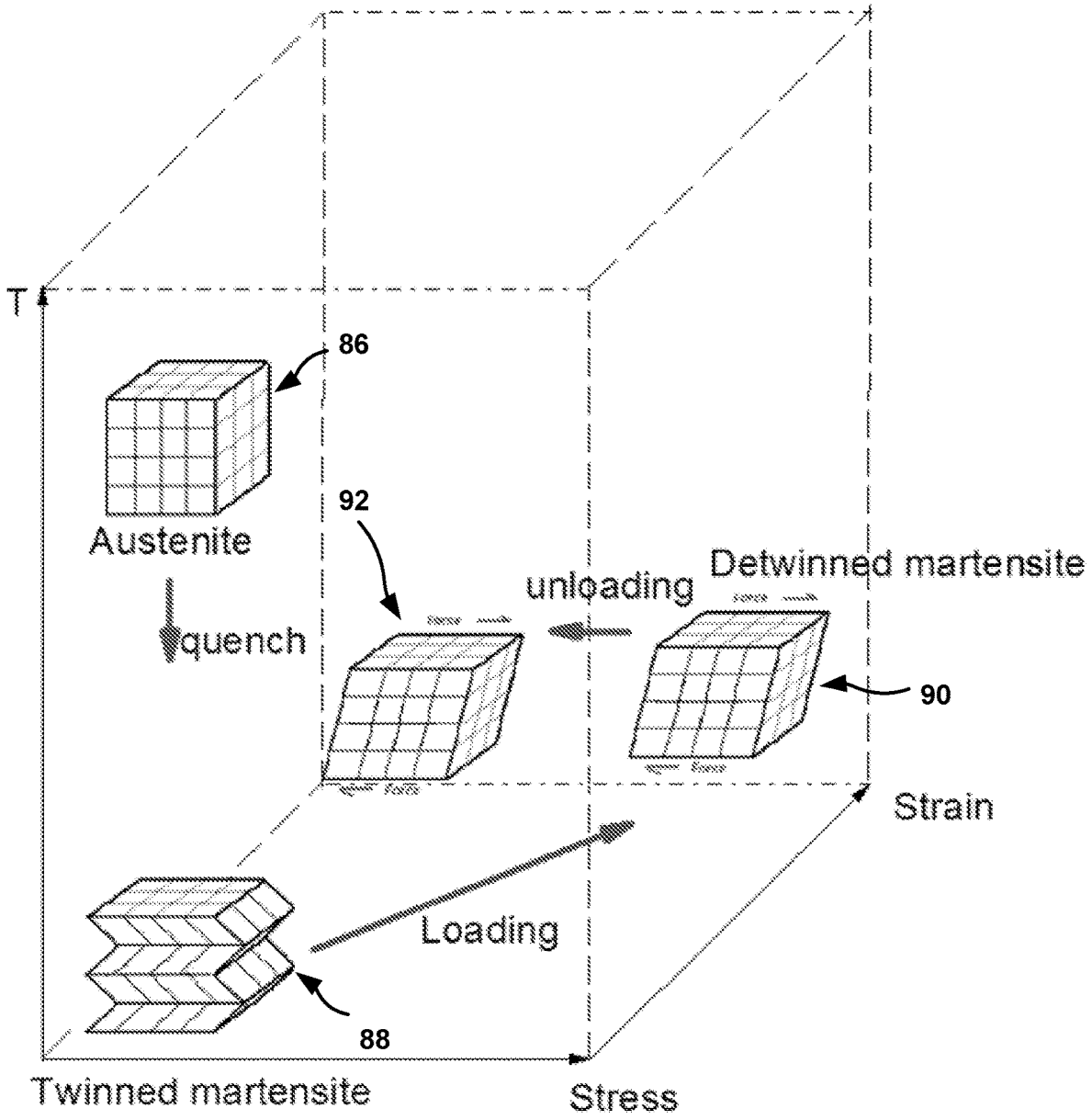
FIG. 14 is a conceptual phase transformation diagram illustrating formation of detwinned martensite $Fe_{16}N_2$.

As described herein, an iron nitride-containing workpiece may exhibit differing magnetic properties depending on the type of iron nitride phase(s) within the material of the workpiece. For example, $\alpha''$-$Fe_{16}N_2$, $\alpha'$-$Fe_8N$, $\gamma$-$Fe_4N$, and other types of iron nitride phases may possess different magnetic properties, and domains of these respective phases may contribute different properties to a workpiece that includes one or more of these iron nitride phases. FIG. 14 is a conceptual phase transformation diagram illustrating formation of detwinned martensite $Fe_{16}N_2$. In general, as shown in FIG. 14, techniques of this disclosure may include formation of an $\alpha''$-$Fe_{16}N_2$ phase (detwinned martensite $Fe_{16}N_2$) by, for example, quenching an iron nitride-containing workpiece including an austenite $\gamma$-$Fe_4N$ phase 86 to form an iron nitride-containing workpiece including a twinned martensite $\alpha'$-$Fe_8N$ phase 88. Example techniques further may include stress-assisted annealing of the iron nitride-containing workpiece including twinned martensite $\alpha'$-$Fe_8N$ phase 88 to form an iron nitride-containing workpiece including a detwinned martensite $\alpha''$-$Fe_{16}N_2$ phase 90. In addition, example techniques of this disclosure may include unloading of any stress applied to the iron nitride-containing workpiece before and/or during annealing, such that iron nitride-containing workpiece including detwinned martensite $\alpha''$-$Fe_{16}N_2$ 90 remains in a strained state upon unloading of the stress, as shown in FIG. 14. As discussed in greater detail below, this disclosure describes various techniques for preserving strain in detwinned martensite $\alpha''$-$Fe_{16}N_2$ (also referred to herein as $\alpha''$-$Fe_{16}N_2$ or $Fe_{16}N_2$).

Figure 15:
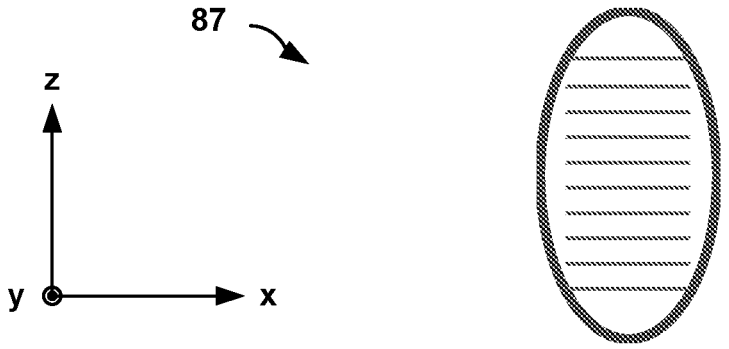
FIG. 15 is a conceptual diagram illustrating an example anisotropically shaped $\alpha''$-$Fe_{16}N_2$ crystal or grain.

Although not wishing to be bound by theory, three types of anisotropy may contribute to the magnetic anisotropy energy or magnetic anisotropy field of $\alpha''$-$Fe_{16}N_2$ or other iron-based magnetic materials. These three types of anisotropy include magnetocrystalline anisotropy, shape anisotropy, and strain anisotropy. Magnetocrystalline anisotropy may be related to the distortion of the bcc iron crystalline lattice into the bct iron-nitride crystalline lattice shown in FIG. 4. Shape anisotropy may be related to the shape of the iron nitride crystals or grains, or to the shape of iron nitride workpieces. For example, as shown in FIG. 15, an $\alpha''$-$Fe_{16}N_2$ crystal or grain 87 may define a longest dimension (substantially parallel to the z-axis of FIG. 15, where orthogonal x-y-z axes are shown for ease of description only). $\alpha''$-$Fe_{16}N_2$ crystal or grain 87 also may define a shortest dimension (e.g., substantially parallel to the x-axis or y-axis of FIG. 15). The shortest dimension may be measured in a direction orthogonal to the longest axis of $\alpha''$-$Fe_{16}N_2$ crystal or grain 87.

In some examples, $\alpha''$-$Fe_{16}N_2$ crystal or grain 87 may define an aspect ratio of between about 1.1 and about 50, such as between about 1.4 and about 50, or between 2.2 and about 50, or between about 5 and about 50. In some examples, the shortest dimension of $\alpha''$-$Fe_{16}N_2$ crystal or grain 87 is between about 5 nm and about 300 nm.

Strain anisotropy may be related to strain exerted on the $\alpha''$-$Fe_{16}N_2$ or other iron-based magnetic materials. In some examples, $\alpha''$-$Fe_{16}N_2$ grains are disposed or embedded within a matrix that includes grains of iron or other types of iron nitride (e.g., $Fe_4N$). The $\alpha''$-$Fe_{16}N_2$ grains may possess a different coefficient of thermal expansion than the grains of iron or other types of iron nitride. This difference can introduce strain into the $\alpha''$-$Fe_{16}N_2$ grains due to differential dimensional changes in the $\alpha''$-$Fe_{16}N_2$ grains and the grains of iron or other types of iron nitride during thermal processing. Alternatively or additionally, the material or workpiece may be subjected to mechanical strain (as described throughout this application) or strain due to exposure to an applied magnetic during processing to form $\alpha''$-$Fe_{16}N_2$ grains, at least some of which strain may remain in the material or workpiece after processing. Annealing may result in redistribution of the internal stress and local microstructure of the sample in order to reduce the magnetoelastic energy in the stressed state. The magnetic domain structure under strain anisotropy depends on the magnetoelastic energy, magnetostatic energy, and exchange energy.

Figure 16:
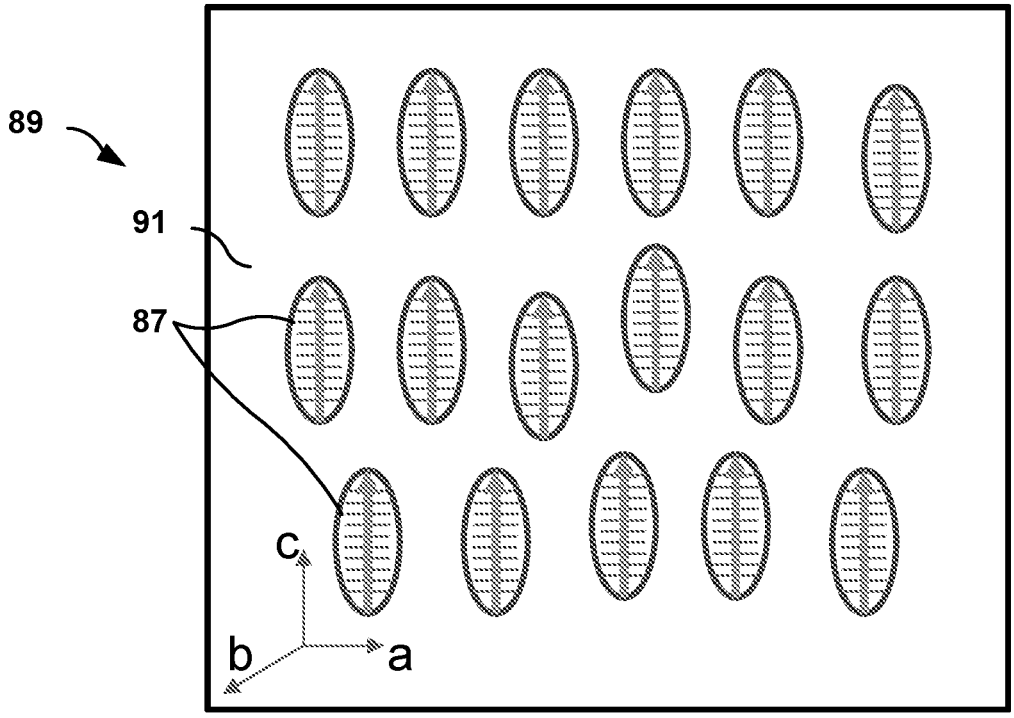
FIG. 16 is a conceptual diagram illustrating an example workpiece that includes a plurality of $\alpha''$-$Fe_{16}N_2$ crystal or grains in a matrix of other material.

FIG. 16 is a conceptual diagram illustrating an example workpiece 89 that includes a plurality of $\alpha''$-$Fe_{16}N_2$ crystal or grains 87 in a matrix 91 of other material. As shown in FIG. 16, each of the $\alpha''$-$Fe_{16}N_2$ crystal or grains 87 defines an anisotropic shape. Further, the magnetic easy axis of each respective $\alpha''$-$Fe_{16}N_2$ crystal or grain of the $\alpha''$-$Fe_{16}N_2$ crystal or grains 87 is substantially parallel to (e.g., parallel to or nearly parallel to) the respective longest dimension of the respective $\alpha''$-$Fe_{16}N_2$ crystal or grain. In some examples, the magnetic easy axis of each respective $\alpha''$-$Fe_{16}N_2$ crystal or grain may be substantially parallel (e.g., parallel to or nearly parallel to) the other respective magnetic easy axes (and, thus, substantially parallel (e.g., parallel to or nearly parallel to) the other respective longest dimensions). In some examples, this may be accomplished by straining the material used to form workpiece 89, as described above. In this way, workpiece 89 may possess structural characteristics that result in magnetocrystalline anisotropy, shape anisotropy, and strain anisotropy all contributing to the anisotropy field of workpiece 89.

Figure 17:
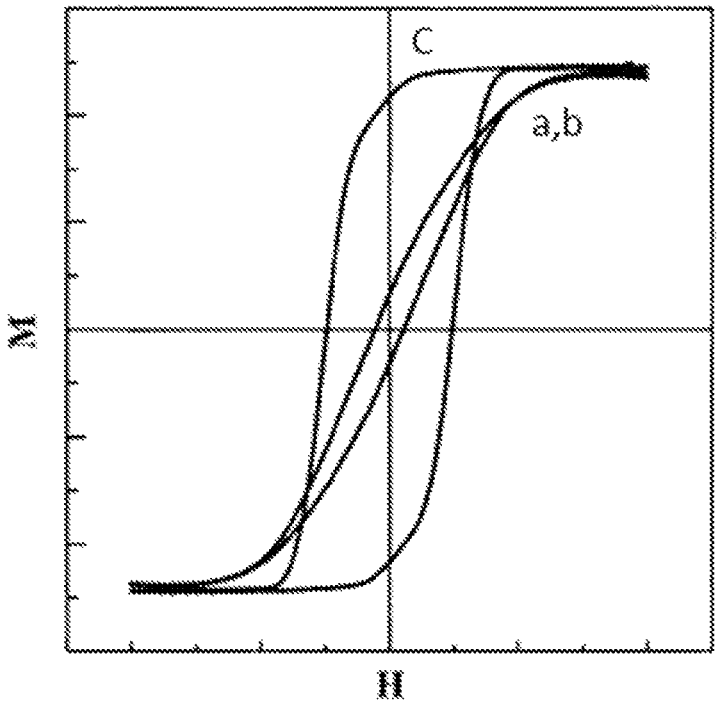
FIG. 17 is a diagram illustrating example hysteresis curves for workpiece 89.

FIG. 17 is a diagram illustrating example hysteresis curves for workpiece 89. The hysteresis curves shown in FIG. 17 illustrate that workpiece 89 possesses magnetic anisotropy, as the coercivity (the x-axis intercepts) of workpiece 89 when the magnetic field is applied parallel to the c-axis direction of FIG. 16 is different than the coercivity (the x-axis intercepts) of workpiece 89 when the magnetic field is applied parallel to the a-axis and b-axis directions of FIG. 16.

An iron nitride-containing workpiece, as described herein, may take any one of a number of shapes. For example, an iron nitride-containing workpiece may take the shape of a ribbon, film, thin film, powder, wire, rod, bar, conduit, hollow conduit, fiber, sheet, bulk material, ingot, or the like. Further, example iron nitride-containing workpieces may have a variety of cross-sectional shapes and sizes, and may contain any combination of the types of shapes described herein.

Figure 18:
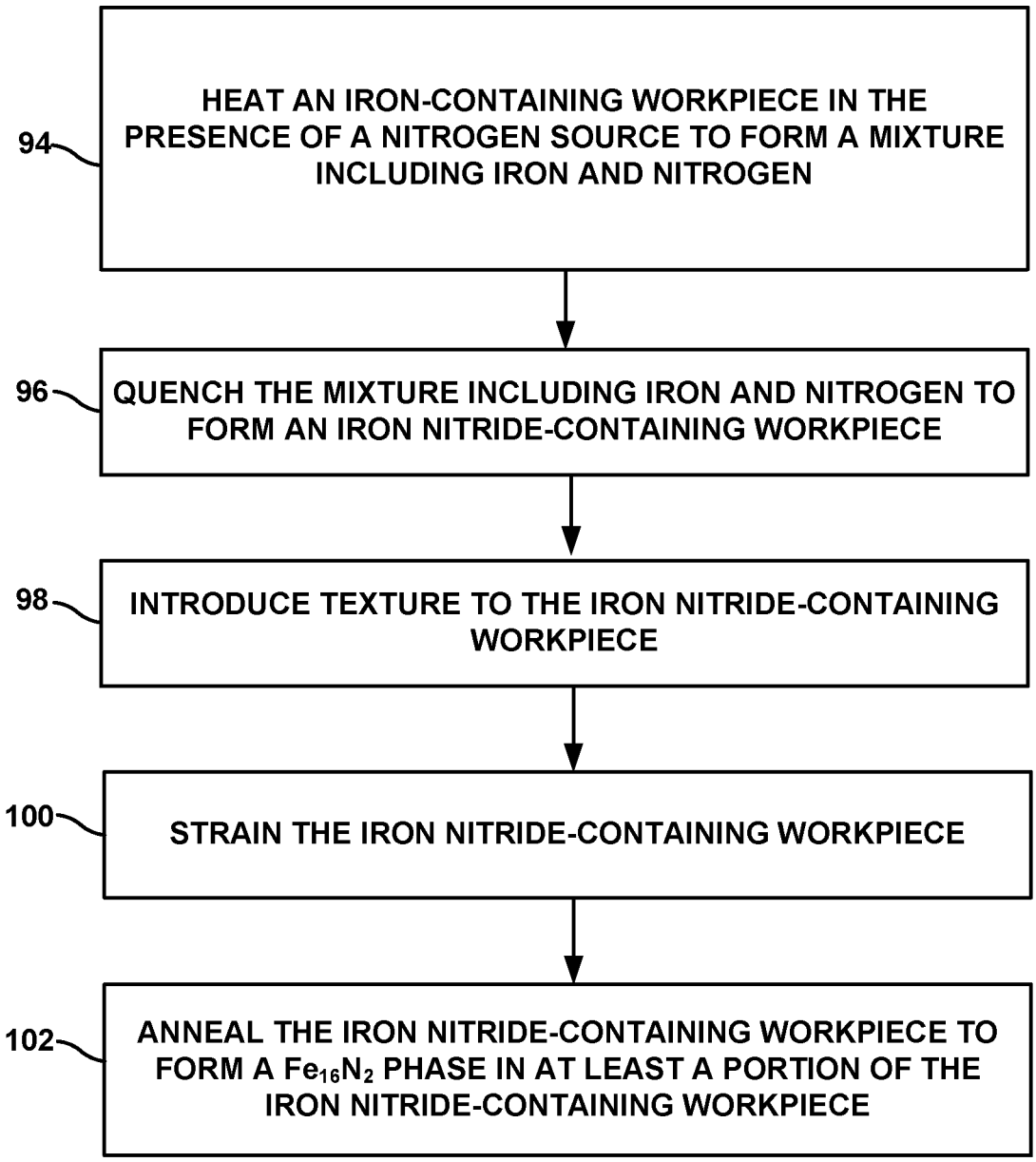
FIG. 18 is a flow diagram that illustrates an example technique for forming and introducing texture to an iron nitride-containing workpiece that includes at least one $\alpha''$-$Fe_{16}N_2$ phase domain.

FIG. 18 is a flow diagram that illustrates an example technique for forming and introducing texture to an iron nitride-containing workpiece that includes at least one $\alpha''$-$Fe_{16}N_2$ phase domain. In some examples, as described above with respect to FIG. 8, an example technique of this disclosure may include heating an iron-containing workpiece in the presence of a nitrogen source to form a mixture including iron and nitrogen (94). For example, the mixture including iron and nitrogen may include a $\gamma$-$Fe_4N$ phase 86, as discussed with respect to FIG. 14. In some examples, this technique may include heating an iron-containing workpiece in the presence of a nitrogen source at a temperature of at least 650° C., or greater. For example, at least the iron-containing workpiece may be heated to at least 650° C. in the presence of the nitrogen source. In addition, the nitrogen source utilized for this technique may include any of the nitrogen sources described herein. For example, the iron source may include atomic nitrogen (e.g., supplied as diatomic nitrogen ($N_2$), which is then separated (cracked) into individual nitrogen atoms), ammonia ($NH_3$), an amine, ammonium nitrate ($NH_4NO_3$), an amide-containing material, a hydrazine-containing material or urea ($CO(NH_2)_2$).

In some examples, the iron-containing workpiece may be strained during the nitridization process. For example, the technique of FIG. 18 may include heating the iron-containing workpiece in the presence of a nitrogen source while straining the iron-containing workpiece using any of the straining and/or heating apparatuses described in connection with the technique of FIG. 1 and FIGS. 2, 3, 6, and 7 above.

The iron-containing workpiece utilized for this technique may include, for example, iron powder, bulk iron, $FeCl_3$, $Fe_2O_3$, or $Fe_3O_4$. In some examples, these materials include a plurality of iron crystals. The iron-containing workpiece may take any one of a number of forms, such as a ribbon, film, thin film, powder, wire, rod, bar, conduit, hollow conduit, fiber, sheet, bulk material, ingot, or the like. Further, example iron-containing workpieces may have a variety of cross-sectional shapes and sizes, and contain any combination of the types of shapes described herein.

In some examples, the mixture including iron and nitrogen formed by heating the iron-containing workpiece in the presence of a nitrogen source may include other phases in addition to a $\gamma$-$Fe_4N$ phase 86. For example, the mixture including iron and nitrogen may include $\alpha''$-$Fe_{16}N_2$ phase domains, $Fe_2N$ phase domains, $Fe_3N$ phase domains, $\gamma$-$Fe_4N$ phase domains, $\alpha'$-$Fe_8N$, or the like. The mixture including iron and nitrogen also may include a plurality of iron nitride crystals. Moreover, the mixture including iron and nitrogen may be a workpiece that takes any one of a number of forms, such as a ribbon, film, thin film, powder, wire, rod, bar, conduit, hollow conduit, fiber, sheet, bulk material, ingot, or the like. Further, such a workpiece may have a variety of cross-sectional shapes and sizes, and contain any combination of the types of shapes described herein.

In general, example techniques that include heating an iron-containing workpiece in the presence of a nitrogen source to form a mixture including iron and nitrogen (94), and quenching the mixture including iron and nitrogen (96), may be similar to or the same as techniques described above in this disclosure, for example nitridizing techniques described above that allow nitrogen atoms to interstitially diffuse or implant within iron crystal lattices to form iron nitride materials. For example, materials, processing times, and temperatures utilized in techniques for forming strained iron nitride-containing workpiece (such as $Fe_{16}N_2$) may be the same as or similar to techniques described above. Accordingly, in some examples, a technique may include nitridizing an iron-containing workpiece to form the mixture including iron and nitrogen, before texture is introduced to the iron nitride-containing workpiece.

An example technique of this disclosure also may include quenching the mixture including iron and nitrogen to form an iron nitride-containing workpiece (96). In some examples, quenching the mixture including iron and nitrogen includes quenching a mixture including a $\gamma$-$Fe_4N$ phase having a temperature of at least approximately 650° C. for a suitable time and in a suitable medium to lower the temperature of the mixture including iron and nitrogen and form $\alpha'$-$Fe_8N$ phase 88 in the material. The $\alpha'$-$Fe_8N$ phase may include twinned martensite crystals, with individual crystal cells taking a bct configuration, as described above. In some examples, quenching the mixture including iron and nitrogen (96) may include cooling the heated mixture including iron and nitrogen by circulating cold water around an apparatus in which the material has been heated, such as around the outside of a crucible, to rapidly cool the contents. For example, the temperature may be decreased from about 650° C. to room temperature in about 20 seconds.

In some examples, a $\gamma$-$Fe_4N$ sample may be quenched at a temperature of at least approximately 650° C. under stress-free conditions to a lower temperature, as shown in FIG. 14. As the austenite phase is quenched, a martensite phase may form that has multiple variants and twin defects present. For example, upon quenching, at least one of $\alpha'$-$Fe_8N$ or $\alpha''$-$Fe_{16}N_2$ phases may be present within the iron nitride-containing workpiece. While some or all of such variants of the martensite phase may be crystallographically equivalent, the variants may have differing habit plane indices, for example, differing crystallographic planes along which twinning of crystals may occur. Accordingly, the $\alpha'$-$Fe_8N$ phase constitution may be viewed as a chemically disordered counterpart of a chemically ordered $\alpha''$-$Fe_{16}N_2$ phase.

The technique of FIG. 18 also includes introducing texture to the iron nitride-containing workpiece (98). As described above, for example, a textured iron nitride-containing workpiece may include a plurality of iron nitride crystals with a desired orientation with respect to a certain direction of the iron nitride-containing workpiece. Texture may be described, in some examples, as weak or strong, depending on the degree to which the crystal axes of adjacent iron crystals are oriented in a similar manner. In some examples, texture within an iron crystal lattice may substantially preserve (e.g., preserve or nearly preserve) the iron crystal lattice in a strained state. For example, a textured iron crystal lattice, including boundaries between grains of the textured iron crystal lattice, may more readily preserve strain as compared to iron crystal lattices lacking texture. In some examples, texture may be introduced after quenching but before annealing.

For example, introducing texture to the iron nitride-containing workpiece (98) may include etching the iron nitride-containing workpiece to form crystallographic texture in the iron nitride-containing workpiece. In some examples, etching may include exposing the iron nitride-containing workpiece to etchants that remove material (e.g., atoms) from one or more surfaces of the iron nitride-containing workpiece. Further, in some examples, different crystallographic planes may have varying atomic densities across the planes. Accordingly, etching may proceed anisotropically (e.g., depending upon the orientation of the crystallographic planes to the surface of the iron nitride-containing workpiece) as atoms are removed from differing crystallographic planes, to introduce texture to the iron nitride-containing workpiece.

Suitable etchants for this technique may include, for example, diluted nitric acid ($HNO_3$). In some examples, the $HNO_3$ may have a concentration of between about 5% and about 20% in the diluted $HNO_3$ solution. Further, in some examples, etching may proceed at room temperature (about 23° C.). In addition or alternatively, in some examples, a technique of this disclosure may include, after formation of the mixture including iron and nitrogen described above but before quenching the mixture to form the iron nitride-containing workpiece, etching the mixture including iron and nitrogen to form crystallographic texture in the mixture including iron and nitrogen. Etching of the mixture of iron and nitrogen in such an example may proceed in a manner similar to or the same as etching an iron nitride-containing workpiece after quenching, as described above.

As another example, introducing texture to the iron nitride-containing workpiece (98) may include exposing the iron nitride-containing workpiece to a magnetic field during heating of the material, e.g., in the crucible heating stage 26 described above, or heating to form a molten mixture as described in more detail in International Patent Application Number PCT/US14/15104 entitled "IRON NITRIDE PERMANENT MAGENT AND TECHNIQUE FOR FORMING IRON NITRIDE PERMANENT MAGNET," filed on Feb. 6, 2014. International Patent Application Number PCT/US14/15104 is incorporated herein by reference in its entirety. Thus, in some examples, introducing texture to the iron nitride-containing workpiece (98) may occur simultaneously with heating an iron-containing workpiece in the presence of a nitrogen source to form the iron nitride-containing workpiece (94) and/or simultaneously with quenching the iron nitride-containing workpiece (96). In some examples, the magnetic field applied to the iron nitride-containing workpiece to impart texture may have a strength of between about 0.01 Tesla (T) and about 10 T.

In some examples, texture may be introduced before quenching. For example, after or while heating an iron-containing workpiece in the presence of a nitrogen source to form the iron nitride-containing workpiece, but before quenching, texture may be introduced to the workpiece by applying an external force along a predetermined orientation, exposing the workpiece to a magnetic field, melting spinning the material, and/or etching the workpiece, as described in greater detail herein. In other examples, texture may be introduced before formation of the iron nitride-containing workpiece. For example, texture may be introduced to the iron-containing workpiece before heating the iron-containing workpiece in the presence of a nitrogen source to form the mixture including iron and nitrogen (94). In some of these examples, texture may be introduced at room temperature (about 23° C.). For example, texture may be introduced to the iron-containing workpiece, as described herein, by applying an external force along a predetermined orientation, exposing the workpiece to a magnetic field, melting spinning the material, and/or etching the workpiece. In some of these examples, texture imparted on the iron-containing workpiece may remain present in the material at least up to a temperature of 650° C.

The technique of FIG. 18 may further include straining the iron nitride-containing workpiece (100). In some examples, straining may include stressing the iron nitride-containing workpiece to induce plastic deformation within the iron nitride-containing workpiece. For example, iron nitride crystals of the iron nitride-containing workpiece may be plastically deformed by the applied strain. In some examples, the iron nitride-containing workpiece may be plastically deformed by application of between about 7% and about 10% strain. Any of the straining apparatuses described in this disclosure may be utilized to apply such strain, among others.

In some examples, straining may include applying a suitable tensile force to opposing ends of an iron nitride-containing workpiece. Further, in some examples, straining the iron nitride-containing workpiece (100) may include applying a compressive force to the iron nitride-containing workpiece along at least one axis orthogonal to the axis of the applied tensile force. In some examples, straining the iron nitride-containing workpiece also may include straining the iron nitride-containing workpiece in a direction substantially parallel to respective <001> crystal axes of the plurality of iron nitride crystals within the workpiece.

Straining of the iron nitride-containing workpiece may occur, for example, before and/or during annealing of the iron nitride-containing workpiece. Further, in some examples, the iron-containing workpiece may be strained before formation of the iron nitride-containing workpiece. For example, before heating the iron-containing workpiece (94), one example technique may include straining the iron-containing workpiece described herein using any of the straining apparatuses described in this disclosure, among others. Straining the iron-containing workpiece may form a textured iron-containing workpiece, which then may be nitridized to form a textured iron nitride-containing workpiece. The texture may remain in the textured material during subsequent processing, e.g., if the temperature of the textured workpiece is maintained below a temperature at which the texture begins to be destroyed. For example, the textured workpiece may be maintained below a temperature of about 650° C. to avoid destroying texture of the textured workpiece.

The technique of FIG. 18 also may include annealing the strained iron nitride-containing workpiece to form a $Fe_{16}N_2$ phase in at least a portion of the strained iron nitride-containing workpiece (102). In some examples, once the iron nitride-containing workpiece has been quenched, the iron nitride-containing workpiece may be annealed at a temperature for a time to facilitate diffusion of the nitrogen atoms into appropriate interstitial spaces within the iron lattice to form $\alpha''$-$Fe_{16}N_2$, as described above. In some examples, as shown in FIG. 14, straining the iron nitride-containing workpiece may include straining the iron nitride-containing workpiece including twinned martensite $\alpha'$-$Fe_8N$ phase 88 while annealing (e.g., heating for a predetermined time) to form the detwinned martensite $\alpha''$-$Fe_{16}N_2$ phase 90 in at least a portion (or all) of the iron nitride-containing workpiece.

In some examples, as also described above, annealing the iron nitride-containing workpiece to form the $Fe_{16}N_2$ phase may include annealing at a temperature between about 100° C. and about 300° C. In other examples, the annealing temperature may be below approximately 200° C. for a suitable amount of time. For example, the annealing temperature may be about 126.85° C. (about 400 Kelvin). Iron nitride-containing workpiece may be annealed using, for example, the Crucible heating stage 26, a plasma arc lamp, a radiation heat source, such as an infrared heat lamp, an oven, or a closed retort. The annealing process may continue for a predetermined time that is sufficient to allow diffusion of the nitrogen atoms to the appropriate interstitial spaces. In some examples, the annealing process continues for between about 20 hours and about 100 hours, such as between about 40 hours and about 60 hours. In some examples, the annealing process may occur under an inert atmosphere, such as Ar, to reduce or substantially prevent oxidation of the iron. In some implementations, while the iron nitride-containing workpiece is annealed, the temperature is held substantially constant.

In some examples, in stressing a martensite iron nitride-containing workpiece, multiple types of martensite may be formed. For example, different variants of martensite may form upon stressing of iron nitride-containing workpiece depending on whether the martensite forms before or after plastic yielding. For example, a stress-induced martensite may form prior to plastic yielding (e.g., during a period of elastic yielding of the iron nitride-containing workpiece). In addition or alternatively, a strain-induced martensite may form during or after a stress applied to the iron nitride-containing workpiece reaches a point of plastic yielding (e.g., permanent deformation of the workpiece). In some examples, a plate martensite may form from unstrained martensite, while a fine, lathlike martensite may form in the iron nitride-containing workpiece from a strain-inducing load. Formation of the lathlike martensite may be related, for example, to slip occurring in the parent austenite phase of the iron nitride-containing workpiece.

In some examples, when the stress or load applied to the iron nitride-containing workpiece including $Fe_8N$ reaches a certain critical stress (e.g., a point of plastic yielding of the iron nitride-containing workpiece), the twinned martensite crystals may de-twin and form stress-preferred twins, as shown in FIG. 14. In this way, the multiple martensite variants present in the $\alpha'$-$Fe_8N$ phase begin to convert to a single variant, for example, a preferred $\alpha''$-$Fe_{16}N_2$ phase determined by alignment of habit planes with the axis of loading. In some examples involving anisotropically shaped iron nitride-containing workpieces, an axis of loading may be substantially aligned with a longest dimension of the anisotropic iron nitride-containing workpiece.

In some examples, as a strain-inducing load is being applied, multiple martensite phases present in a sample iron nitride-containing workpiece may convert to a single martensite phase, such as an $\alpha''$-$Fe_{16}N_2$ martensite phase whose habit planes are aligned with the axis of loading, as described. Again, in some examples, such a strain-inducing load is applied while the iron nitride-containing workpiece is being annealed. In some examples, an iron nitride-containing workpiece including an $\alpha''$-$Fe_{16}N_2$ phase 90 that forms as a consequence of plastic deformation may occur by a mechanism different from that of unstressed or even stressed martensite (with a load below a point of plastic yielding). For example, while a strain-induced $Fe_{16}N_2$ martensite phase may have the same crystal structure (e.g., bct) as typical spontaneous $Fe_{16}N_2$ martensite or stress-assisted $Fe_{16}N_2$ martensite, the morphology, phase distribution, temperature dependence, and other characteristics of the strain-induced $Fe_{16}N_2$ martensite phase may be different from other $Fe_{16}N_2$ martensite variants. For example, a strain-induced $Fe_{16}N_2$ martensite phase may have a higher saturation magnetization and a higher decomposition temperature, as compared to other $Fe_{16}N_2$ martensite variants. In some examples, a strain-induced $Fe_{16}N_2$ martensite phase may form a superlattice having nitrogen atoms aligned along a (002) crystallographic plane of one or more iron nitride crystals.

Strain may be preserved using a number of techniques. In some examples, as described, preserving strain in iron nitride-containing workpieces may include introducing texture to ribbon or bulk materials including $Fe_{16}N_2$. For example, texture may be introduced by at least one of etching, magnetic agitation (exposure to a magnetic field), application of an external force along a predetermined orientation, or a melting spinning technique. In some examples, texture previously introduced to an annealed iron nitride-containing workpiece including the $Fe_{16}N_2$ phase may substantially preserve (e.g., preserve or nearly preserve) strain within the annealed iron nitride-containing workpiece. Preservation of strain in an iron nitride-containing workpiece including $Fe_{16}N_2$ (e.g., a permanent magnet) may preserve or enhance magnetic properties of the workpiece, such as coercivity, magnetization, magnetic orientation, and energy product of the workpiece.

For example, as shown in FIG. 14, upon removal or unloading of the stress that induced straining of the iron nitride-containing workpiece (100), texture previously introduced to the annealed iron nitride-containing workpiece including the $Fe_{16}N_2$ phase may substantially preserve strain within the iron nitride-containing workpiece including an $\alpha''$-$Fe_{16}N_2$ phase 92. Accordingly, in some examples, a disclosed technique of this disclosure may include removal or unloading of a stress that induces a strain following, for example, straining and/or annealing of the iron nitride-containing workpiece. In some examples, a disclosed technique also includes cooling of the annealed iron nitride-containing workpiece including $\alpha''$-$Fe_{16}N_2$ 90 to form the iron nitride-containing workpiece including $\alpha''$-$Fe_{16}N_2$ 92, as shown in FIG. 14. In some examples, unloading and cooling of the $\alpha''$-$Fe_{16}N_2$ 90 material to form the $\alpha''$-$Fe_{16}N_2$ 92 material may occur simultaneously.

Texture may be introduced to iron-containing workpiece or iron nitride-containing workpieces by other methods as well, for example, either before heating, before quenching, or after quenching but before annealing, according to examples described herein. In some examples, an external force may be applied to the iron nitride-containing workpiece along a predetermined orientation to introduce texture to the iron nitride-containing workpiece. As described above, for example when a tensile force is applied to a single iron crystal or plurality of iron crystal unit cells, e.g., in a direction substantially parallel to one of the crystal axes, such as the <001> crystal axis, the iron crystal unit cells (including, e.g., iron nitride crystals) may substantially align to introduce texture to the iron nitride-containing workpiece. In some examples, texture within an iron nitride-containing workpiece may include a configuration where at least some common crystal axes of at least some (or substantially all) of the iron nitride crystals are in substantially parallel alignment (parallel or nearly parallel). As examples, one or more of <100>, <010>, and <001> axes may be in substantially parallel alignment upon introduction of texture to the workpiece. Apparatuses for straining described herein may be utilized to apply the external force to the iron-containing or iron nitride-containing workpiece to impart texture, among others.

In addition or alternatively, texture may be introduced to iron nitride-containing workpiece or iron-containing workpiece using a melting spinning technique. For example, in melting spinning, an iron precursor or iron-containing workpiece may be melted, e.g., by heating the iron-containing workpiece in a furnace to form molten iron-containing workpiece. The molten iron-containing workpiece then may be flowed over a cold roller surface to quench the molten iron-containing workpiece and form a brittle ribbon of material. Accordingly, texture may be introduced to the iron crystals as they form during quenching at the cold roller surface.

In some examples, the cold roller surface may be cooled at a temperature below room temperature by a cooling agent, such as water. For example, the cold roller surface may be cooled at a temperature between about 10° C. and about 25° C. The brittle ribbon of material may then undergo a heat treatment step to pre-anneal the brittle iron-containing workpiece. In some examples, the heat treatment may be carried out at a temperature between about 200° C. and about 600° C. at atmospheric pressure for between about 0.1 hour and about 10 hours. In some examples, the heat treatment may be performed in a nitrogen or argon atmosphere. After heat-treating the brittle ribbon of material under an inert gas, the brittle ribbon of material may be shattered to form, for example, an iron-containing powder with texture (e.g., with a plurality of iron crystals arranged in a substantially uniform, preferred orientation).

Figure 20:
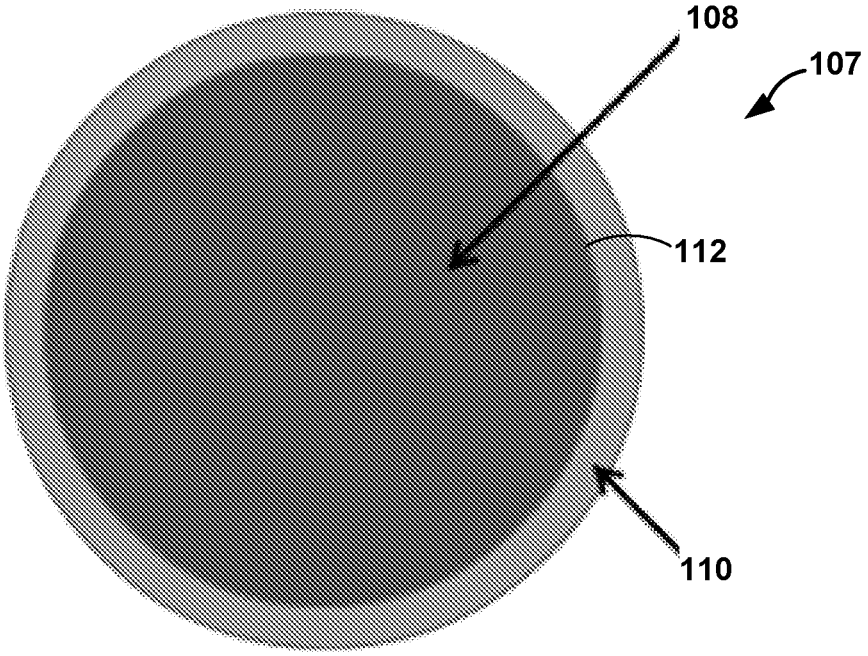
FIG. 20 is a conceptual diagram of a cross-section of an example coated iron nitride-containing nanoparticle including at least one $\alpha''$-$Fe_{16}N_2$ phase domain.

Strain within iron nitride-containing workpieces may be preserved using other techniques as well, alternatively or in addition to introducing texture. For example, a layer or coating of material having a different coefficient of thermal expansion may be utilized in conjunction with an iron nitride-containing thin film or nanoparticle including at least one $\alpha''$-$Fe_{16}N_2$ phase domain, as described in greater detail below. Such a nanoparticle or thin film may be strained prior to application of the layer of material, according to techniques described by this disclosure, or other suitable techniques. FIG. 20 is a conceptual diagram of a cross-section of an example coated iron nitride-containing nanoparticle including at least one $\alpha''$-$Fe_{16}N_2$ phase domain. As shown in FIG. 20, an iron nitride-containing nanoparticle including at least one $\alpha''$-$Fe_{16}N_2$ phase domain 108 is coated by a layer of material 110 to form a coated permanently magnetic nanoparticle 107. Layer of material 110 may include, for example, at least one of $Fe_3O_4$, $Fe_2O_3$, $SiO_2$, $TiO_2$, $SO_2$, $Al_2O_3$, MgO, $Si_3N_4$, $CaCO_3$, Au, Ag, or Ru. Layer of material 110 may substantially encapsulate (e.g., encapsulate or nearly encapsulate) an outer surface of the iron nitride-containing nanoparticle including $Fe_{16}N_2$ 108. In some examples, layer of material 110 may define a thickness between about 1 nanometer (nm) and about 50 nm.

Because layer of material 110 has a different composition than iron nitride-containing nanoparticle 108, layer of material 110 may have a different coefficient of thermal expansion (CTE) than iron nitride-containing nanoparticle 108. Thus, when iron nitride-containing nanoparticle 108 and/or layer of material 110 are heated or cooled, iron nitride-containing nanoparticle 108 and layer of material 110 may change in size in at least one direction in different amounts, such that at least one of a tensile or compressive strain is exerted between the materials at interface 112.

Figure 19:
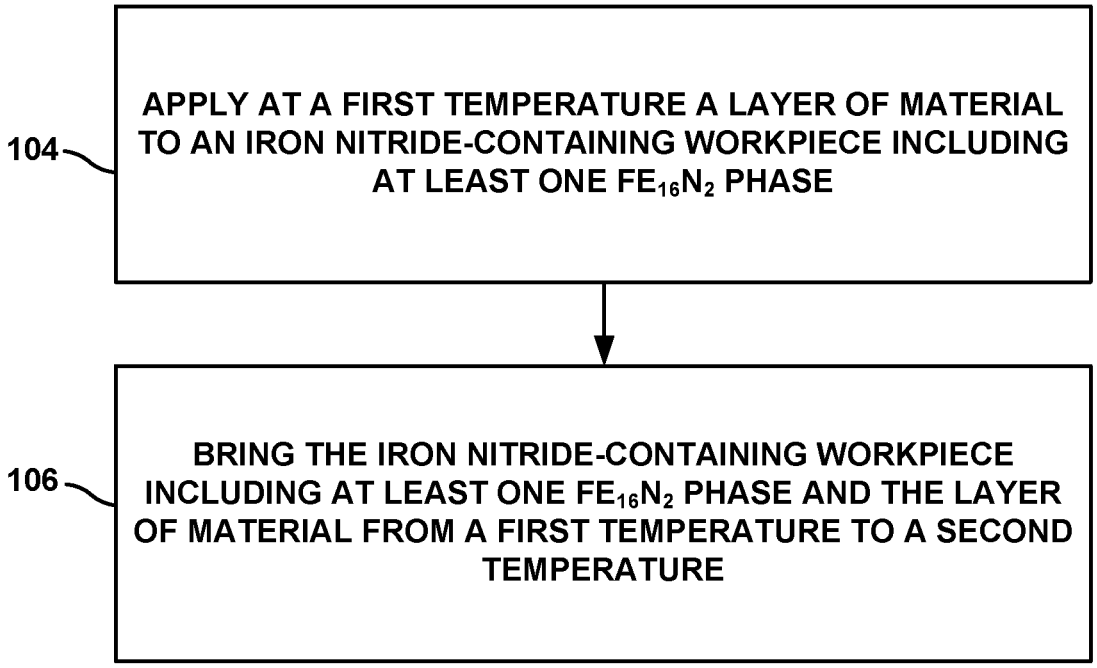
FIG. 19 is a flow diagram illustrating an example technique for preserving strain in an iron nitride-containing workpiece.

FIG. 19 is a flow diagram illustrating an example technique for preserving strain in an iron nitride-containing workpiece. As shown in FIG. 19, in some examples, a technique for preserving strain in iron nitride-containing workpieces may include applying, at a first temperature, a layer of material (e.g., layer of material 110) to an iron nitride-containing workpiece including at least one $\alpha''$-$Fe_{16}N_2$ phase domain (e.g., nanoparticle 108) (104). Upon application of layer of material 110, an interface 112 may be formed between layer of material 110 and iron nitride-containing nanoparticle 108 (see FIG. 20). The iron nitride-containing workpiece including at least one $\alpha''$-$Fe_{16}N_2$ phase domain may be, for example, a nanoparticle (such as nanoparticle 108) or a thin film. An example nanoparticle or thin film may include a detwinned martensite $\alpha''$-$Fe_{16}N_2$ phase throughout at least a portion (or all) or the nanoparticle or thin film.

Layer of material 110 may be applied by any one of a number of suitable techniques. For example, layer of material 110 may be applied to iron nitride-containing nanoparticle 108 via a deposition method, such as chemical vapor deposition or physical vapor deposition, a sol-gel method, or a self-assembly method utilizing difference in surface energies between the layer of material 110 and the iron nitride-containing particle 108.

A technique for preserving strain may further include bringing the iron nitride-containing workpiece including at least one $\alpha''$-$Fe_{16}N_2$ phase domain and the layer of material (e.g., layer of material 110) from the first temperature to a second temperature different from the first temperature to cause at least one of a compressive force or a tensile force on the iron nitride-containing workpiece (e.g., nanoparticle 108) (106). In some examples, the at least one of the compressive force or the tensile force on layer of material 110 may preserve strain in at least a portion of the iron nitride-containing workpiece including the at least one $Fe_{16}N_2$ phase domain. For example, the at least one of the compressive force or the tensile force may preserve one or more detwinned martensite $Fe_{16}N_2$ crystals of nanoparticle 108 in a strained (e.g., plastically deformed) state. Warming or cooling the layer of material and iron nitride-containing workpiece to bring the layer of material and iron nitride-containing workpiece to the second temperature may be accomplished by any suitable technique.

In some examples, the first temperature of layer of material 110 may be higher than the second temperature. In some examples, the first temperature may be between about 200° C. and about 800° C., while the second temperature may be less than 200° C. In other examples, the first temperature of layer of material 110 may be lower than the second temperature.

Upon bringing at least the layer of material 110 to the second temperature, the layer of material 110 may change in dimension relative to iron nitride-containing nanoparticle 108 in at least a direction parallel to the interface between layer of material 110 and iron nitride-containing nanoparticle 108. In some examples, layer of material 110 may reduce in dimension in more than one dimension or all dimensions, depending on, e.g., whether layer of material 110 has an anisotropic or isotropic coefficient of thermal expansion.

In some examples, over the range of temperatures between the first temperature and the second temperature described above, layer of material 110 may have an average coefficient of thermal expansion that is higher than an average coefficient of thermal expansion of the iron nitride-containing nanoparticle 108. For example, the layer 110 may have an average coefficient of thermal expansion that is higher than the iron nitride-containing nanoparticle including at least one $\alpha''$-$Fe_{16}N_2$ phase domain 108 over the range of temperature between the first and second temperature in at least a direction parallel to interface 112. In some examples, layer 110 may have an average volumetric coefficient of thermal expansion that is higher than the average volumetric coefficient of thermal expansion of the strained iron nitride-containing nanoparticle 108, at least over the range of temperatures between the first temperature and second temperature.

In other examples, over the range of temperatures between the first temperature and the second temperature described above, layer of material 110 may have an average coefficient of thermal expansion that is lower than an average coefficient of thermal expansion of the iron nitride-containing nanoparticle 108. For example, the layer 110 may have an average coefficient of thermal expansion that is lower than the iron nitride-containing nanoparticle including at least one $\alpha''$-$Fe_{16}N_2$ phase domain 108 over the range of temperature between the first and second temperature in at least a direction parallel to interface 112. In some examples, layer 110 may have an average volumetric coefficient of thermal expansion that is lower than the average volumetric coefficient of thermal expansion of the strained iron nitride-containing nanoparticle 108, at least over the range of temperatures between the first temperature and second temperature.

Thus, in such an example, upon bringing the layer of material 110 and iron nitride-containing particle 108 to the second temperature, the layer of material 110 may exert at least one of a tensile or a compressive force on the iron nitride-containing nanoparticle 108 in at least a direction parallel to interface 112 (e.g., a shear force at interface 112). In some examples, upon bringing the layer of material 110 and iron nitride-containing particle 108 to the second temperature, the layer of material 110 additionally or alternatively may exert at least one of a tensile or a compressive force on the iron nitride-containing nanoparticle 108 in a direction orthogonal to interface 112. In this way, the tensile or compressive force on layer of material 110 may substantially preserve the iron nitride-containing nanoparticle including at least one $\alpha''$-$Fe_{16}N_2$ phase domain 108 in a strained state. In some examples, a coating or layer of this nature may preserve or enhance magnetic properties of the permanent magnet workpiece, as described herein.

For example, in reference to FIG. 14, once a strain-inducing load is removed from iron nitride-containing workpiece including $\alpha''$-$Fe_{16}N_2$ 92, a compressive or tensile force caused by the layer (such as layer of material 110) may aid in preserving the iron nitride-containing workpiece including $\alpha''$-$Fe_{16}N_2$ 92 in a strained state, along with magnetic properties associated with the strained state. In some examples, the iron nitride-containing workpiece may include one or more $Fe_{16}N_2$ crystals in a strained state, for example as shown in FIGS. 4 and 14.

In some examples, prior to applying the layer at the first temperature to the strained iron nitride-containing workpiece, a technique may further include annealing the iron nitride-containing workpiece while straining the iron nitride-containing workpiece to form the $\alpha''$-$Fe_{16}N_2$ phase in at least a portion of the iron nitride-containing workpiece. Conditions for straining and annealing the iron nitride-containing workpiece may be similar to or the same as conditions described elsewhere in this disclosure.

Figure 21:
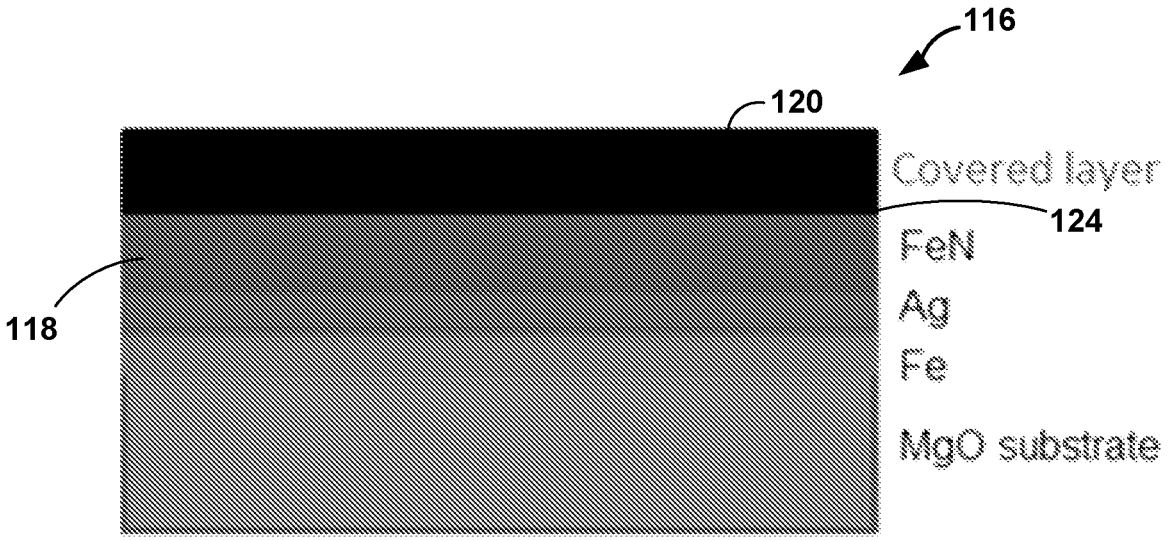
FIG. 21 is a conceptual diagram of a cross-section of an example coated iron nitride-containing thin film including at least one $\alpha''$-$Fe_{16}N_2$ phase domain.

FIG. 21 is a conceptual diagram of a cross-section of an example coated iron nitride-containing thin film including at least one $\alpha''$-$Fe_{16}N_2$ phase domain. As shown in FIG. 21, a coated iron nitride-containing thin film including at least one $\alpha''$-$Fe_{16}N_2$ phase domain 116 includes a layer of material 120 that overlies and covers at least a portion (or all) of an outer surface of an iron nitride-containing thin film 118. In general, materials, conditions, and techniques through which layer of material 120 is applied to thin film 118 and processed may be similar to or the same as the materials, conditions and techniques described above with respect to layer 110 and nanoparticle 108 of FIG. 20. For example, layer of material 120 may include at least one of $Fe_3O_4$, $Fe_2O_3$, $SiO_2$, $TiO_2$, $SO_2$, $Al_2O_3$, MgO, $Si_3N_4$, $CaCO_3$, Au, Ag, or Ru. Layer of material 120 may substantially cover (cover or nearly cover) iron nitride-containing thin film including $Fe_{16}N_2$ 118. In some examples, layer of material 120 may have a thickness from several nanometers to tens of nanometers. For example, layer of material 120 may have a thickness between about 5 nanometers (nm) and about 100 microns (μm).

Further, like the example of FIG. 20, a technique for preserving strain in iron nitride-containing thin film including at least one $\alpha''$-$Fe_{16}N_2$ phase domain 118 may include applying at a first temperature layer 120 to thin film 118. Layer of material 120 may be applied to iron nitride-containing thin film including at least one $\alpha''$-$Fe_{16}N_2$ phase domain 118 in a manner similar to or the same as described with respect to layer 110 and nanoparticle 108. As shown in FIG. 21, upon application of layer of material 120, an interface 124 may be formed between layer of material 120 and iron nitride-containing thin film including at least one $\alpha''$-$Fe_{16}N_2$ phase domain 118. Further, the example technique may include bringing at least the layer of material 120 (and in some examples, at least iron nitride-containing thin film including at least one $\alpha''$-$Fe_{16}N_2$ phase domain 118 as well) to a second temperature. For example, layer of material 120 may preserve one or more detwinned martensite $\alpha''$-$Fe_{16}N_2$ crystals of iron nitride-containing thin film including at least one $\alpha''$-$Fe_{16}N_2$ phase domain 118 in a strained (e.g., plastically deformed) state. Bringing at least layer of material 120 (and in some examples, at least also iron nitride-containing thin film including at least one $\alpha''$-$Fe_{16}N_2$ phase domain 118) to the second temperature may be accomplished by any suitable heating or cooling technique.

Upon bringing at least layer of material 120 to the second temperature (and in some examples, iron nitride-containing thin film including at least one $\alpha''$-$Fe_{16}N_2$ phase domain 118 and/or underlying layers), layer of material 120 may change in dimension in at least a direction substantially parallel to an interface 124 between layer of material 120 and iron nitride-containing thin film including at least one $\alpha''$-$Fe_{16}N_2$ phase domain 118. In some examples, as at least layer of material 120 is brought to the second temperature and changes in width and/or volume, layer of material 120 may exert at least one of a tensile force or a compressive force on the underlying iron nitride-containing thin film including at least one $\alpha''$-$Fe_{16}N_2$ phase domain 118 in at least a direction substantially parallel to the interface 124.

In some examples of coated thin film 116, at least one underlying layer may underlie iron nitride-containing thin film including at least one $\alpha''$-$Fe_{16}N_2$ phase domain 118. For example, a first underlying layer may underlie iron nitride-containing thin film including at least one $\alpha''$-$Fe_{16}N_2$ phase domain 118, and a second underlying layer may be disposed between the first underlying layer and a third underlying layer that underlies the second underlying layer. In some examples, as shown in FIG. 21, the first underlying layer may include silver (Ag), the second underlying layer may include iron (Fe), and the third underlying layer may include magnesium oxide (MgO). Further, in some examples, one or more underlying layer each may define a thickness between about 1 nm and about 100 nm. Likewise, in some examples, iron nitride-containing thin film including at least one $\alpha''$-$Fe_{16}N_2$ phase domain 118 may define a thickness between about 1 nanometer (nm) and about 100 nm.

In some examples, strain within iron nitride-containing workpieces also may be preserved by utilizing compressive and tensile forces to form texture in iron nitride-containing. For example, such forces may be applied to ribbon or bulk materials including $Fe_{16}N_2$. In some examples, compressive and tensile forces may be applied to an iron nitride-containing workpiece at the same time, in different directions, to generate and/or preserve strain in a detwinned martensite $\alpha''$-$Fe_{16}N_2$ phase of the iron nitride-containing workpiece. For example, a tensile force may be applied in one direction or along one axis, while a compressive force is applied in at least one direction or axis orthogonal to the direction or axis of the applied tensile force. In some examples, a tensile force may be applied to an iron nitride-containing workpiece including $Fe_{16}N_2$ in one direction (or along one axis), while compressive forces are applied in two directions (or along two axes) orthogonal to the direction (or axis) of the applied tensile force. These example techniques may be applied during a quenching stage, annealing stage, or both. The referenced quenching and annealing stages may include application of apparatuses and conditions similar to or the same as those described elsewhere herein.

Figure 22:
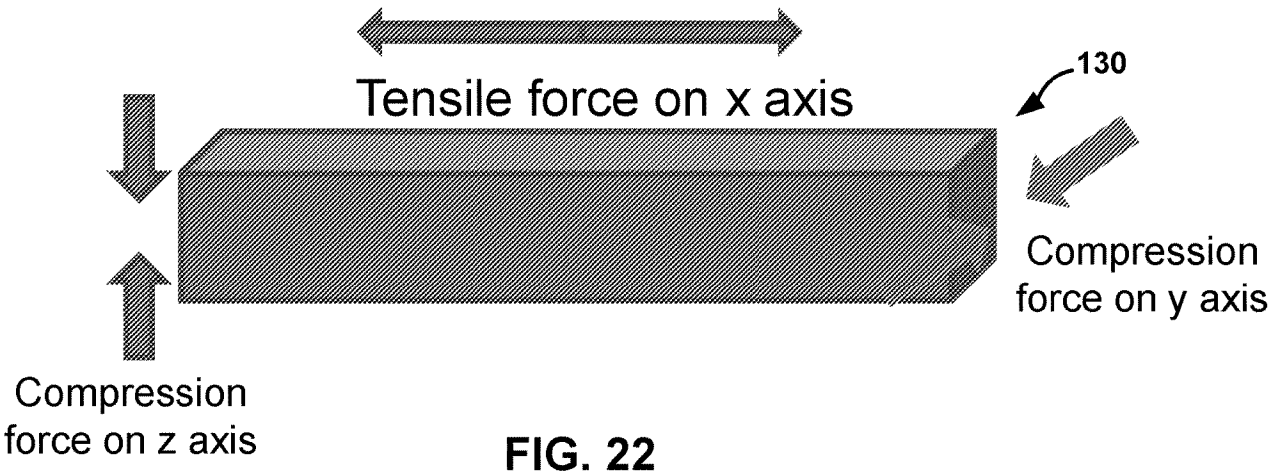
FIG. 22 is a conceptual diagram illustrating the application of tensile and compressive forces to a strained iron nitride-containing bar including an at least one $\alpha''$-$Fe_{16}N_2$ phase domain.
Figure 23:
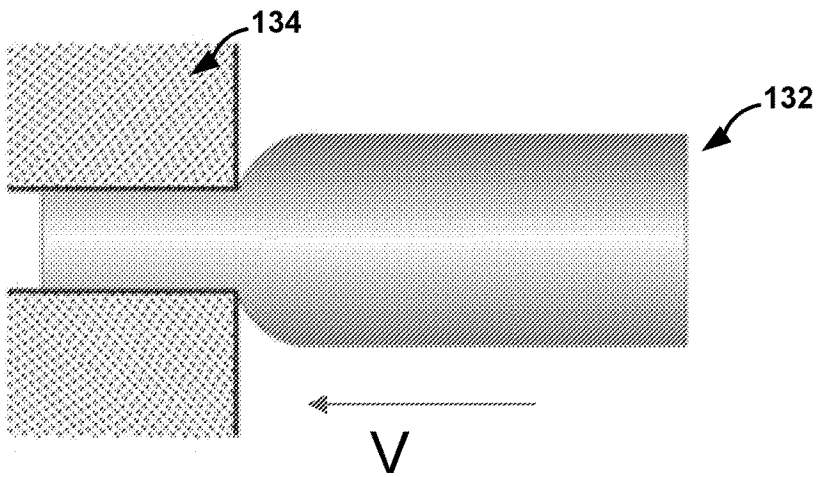
FIG. 23 is a conceptual diagram illustrating a protrude fixture.

FIG. 22 is a conceptual diagram illustrating the application of tensile and compressive forces to a strained iron nitride-containing bar including at least one α"-$Fe_{16}N_2$ phase domain. As shown in FIG. 22, to preserve strain within an iron nitride-containing bar including at least one α"-$Fe_{16}N_2$ phase domain 130, a tensile force is applied along an x axis of the bar, while compressive forces are simultaneously applied along orthogonal y and z axes. This example technique may substantially preserve strain introduced to iron nitride-containing bar including at least one α"-$Fe_{16}N_2$ phase domain 130 by introducing crystallographic texture to the iron nitride-containing bar including at least one α"-$Fe_{16}N_2$ phase domain 130. FIG. 23 is a conceptual diagram illustrating a protrude fixture. A protrude fixture 134 may apply a compressive force to a portion of a strained iron nitride-containing rod 132, as shown by the portion of rod 132 defining a reduced thickness in FIG. 23. Further, a force may be applied in a direction indicated by arrow V in FIG. 23, such that the force along direction V is orthogonal to the compressive force applied to rod 132 by protrude fixture 134.

Clause 1: A method comprising: etching an iron nitride-containing workpiece to form crystallographic texture in the iron nitride-containing workpiece; straining the iron nitride-containing workpiece; and annealing the iron nitride-containing workpiece to form a $Fe_{16}N_2$ phase in at least a portion of the iron nitride-containing workpiece, wherein the texture substantially preserves the strain within the annealed iron nitride-containing workpiece comprising the $Fe_{16}N_2$ phase.

Clause 2: The method of clause 1, further comprising, prior to etching the iron nitride-containing workpiece: heating an iron-containing workpiece in the presence of a nitrogen source to form a mixture including iron and nitrogen; and quenching the mixture including iron and nitrogen to form the iron nitride-containing workpiece.

Clause 3: The method of clause 1, further comprising: heating an iron-containing workpiece in the presence of a nitrogen source to form a mixture including iron and nitrogen, wherein etching the iron nitride-containing workpiece to form crystallographic texture in the iron nitride-containing workpiece comprises etching the mixture including iron and nitrogen to form crystallographic texture in the mixture including iron and nitrogen; and after etching the mixture including iron and nitrogen and before straining the iron nitride-containing workpiece, quenching the mixture including iron and nitrogen to form the iron nitride-containing workpiece.

Clause 4: The method of clause 2 or 3, wherein heating the iron-containing workpiece in the presence of the nitrogen source comprises heating at least the iron-containing workpiece to at least 650° C. in the presence of the nitrogen source.

Clause 5: The method of any one of clauses 1 to 4, wherein etching the iron nitride-containing workpiece comprises exposing the iron nitride-containing workpiece to diluted $HNO_3$, wherein $HNO_3$ has a concentration between about 5% and about 20% in the diluted $HNO_3$.

Clause 6: The method of any one of clauses 1 to 5, wherein straining the iron nitride-containing workpiece comprises applying a tensile force to the iron nitride-containing workpiece.

Clause 7: The method of clause 6, wherein straining the iron nitride-containing workpiece further comprises applying a compressive force to the iron nitride-containing workpiece along at least one axis orthogonal to the axis of the applied tensile force.

Clause 8: The method of any one of clauses 1 to 7, wherein annealing the strained iron nitride-containing workpiece comprises annealing the iron nitride-containing workpiece while straining the iron nitride-containing workpiece.

Clause 9: The method of any one of clauses 1 to 8, wherein annealing the strained iron nitride-containing workpiece comprises heating the strained iron nitride-containing workpiece at between about 100° C. and about 300° C.

Clause 10: The method of clause 9, wherein the strained iron nitride-containing workpiece is heated for between about 20 hours and about 100 hours.

Clause 11: The method of any one of clauses 1 to 10, wherein the iron nitride-containing workpiece is annealed in an inert atmosphere.

Clause 12: The method of any one of clauses 1 to 11, wherein the texture is strong.

Clause 13: The method of any one of clauses 1 to 12, wherein the iron nitride-containing workpiece comprises a plurality of iron nitride crystals.

Clause 14: The method of clause 13, wherein the texture comprises substantially parallel alignment of at least some common crystal axes of at least some of the iron nitride crystals of the plurality of iron nitride crystals.

Clause 15: The method of clause 13 or 14, wherein straining the iron nitride-containing workpiece comprises straining the iron nitride-containing workpiece in a direction substantially parallel to respective <001> crystal axes of the plurality of iron nitride crystals.

Clause 16: The method of any one of clauses 1 to 15, wherein the iron nitride-containing workpiece comprises an iron nitride-containing ribbon, thin film, or bulk workpiece.

Clause 17: A method comprising: applying, at a first temperature, a layer of material to an iron nitride-containing workpiece comprising at least one $Fe_{16}N_2$ phase domain, such that an interface is formed between the layer and the iron nitride-containing workpiece, wherein the material has a different coefficient of thermal expansion than the iron nitride-containing workpiece; and bringing the iron nitride-containing workpiece and the layer of material from the first temperature to a second temperature different than the first temperature to cause at least one of a compressive force or a tensile force on the iron nitride-containing workpiece, wherein the at least one of the compressive force or the tensile force preserves strain in at least the portion of the iron nitride-containing workpiece comprising the at least one $Fe_{16}N_2$ phase domain.

Clause 18: The method of clause 17, wherein the first temperature is higher than the second temperature.

Clause 19: The method of clause 17 or 18, wherein, upon bringing the iron nitride-containing workpiece and the layer of material from the first temperature to the second temperature, the layer of material changes in width in at least one direction parallel to the interface between the layer of material and the iron nitride-containing workpiece, such that the layer of material exerts at least one of a tensile force or a compressive force on the strained iron nitride-containing workpiece in the at least one direction parallel to the interface.

Clause 20: The method of any one of clauses 17 to 19, wherein, over the range of temperatures between the first temperature and the second temperature, the layer of material has an average coefficient of thermal expansion that is higher than an average coefficient of thermal expansion of the iron nitride-containing workpiece in at least one direction parallel to the interface between the layer and iron nitride-containing workpiece.

Clause 21: The method of any one of clauses 17 to 20, further comprising, prior to applying the layer of material, annealing the iron nitride-containing workpiece while straining the iron nitride-containing workpiece to form the at least one $Fe_{16}N_2$ phase domain in at least a portion of the iron nitride-containing workpiece.

Clause 22: The method of any one of clauses 17 to 21, wherein the iron nitride-containing workpiece comprising the at least one $Fe_{16}N_2$ phase domain comprises an iron nitride-containing nanoparticle comprising at least one $Fe_{16}N_2$ phase domain, and wherein the layer of material substantially encapsulates the iron nitride-containing nanoparticle.

Clause 23: The method of clause 22, wherein, over the range of temperatures between the first temperature and the second temperature, the material of the layer of material has an average volumetric coefficient of thermal expansion that is higher than the average volumetric coefficient of thermal expansion of the strained iron nitride-containing nanoparticle.

Clause 24: The method of clause 22 or 23, wherein, when cooled to the second temperature, the layer exerts the at least one of the compressive force or the tensile force on the iron nitride-containing nanoparticle comprising the at least one $Fe_{16}N_2$ phase domain.

Clause 25: The method of any one of clauses 17 to 21, wherein the iron nitride-containing workpiece comprising the at least one $Fe_{16}N_2$ phase domain comprises an iron nitride-containing thin film comprising at least one $Fe_{16}N_2$ phase domain, and wherein the layer of material overlies the iron nitride-containing thin film.

Clause 26: The method of clause 25, wherein, when cooled to the second temperature, the layer of material exerts the at least one of the tensile force or compressive force on the iron nitride-containing thin film comprising the at least one $Fe_{16}N_2$ phase domain.

Clause 27: The method of clause 25 or 26, wherein at least one underlying layer underlies the iron nitride-containing thin film, wherein the layer of material overlies an outer surface of the iron nitride-containing thin film.

Clause 28: The method of clause 27, wherein the at least one underlying layer comprises a first underlying layer, a second underlying layer, and a third underlying layer, wherein the second underlying layer is disposed between the first underlying layer and the third underlying layer, wherein the first underlying layer is directly underlying the iron nitride-containing thin film, and wherein the first underlying layer comprises silver (Ag), the second underlying layer comprises iron (Fe), and the third underlying layer comprises magnesium oxide (MgO).

Clause 29: The method of clause 28, wherein each of the first underlying layer, the second underlying layer, and the third underlying layer defines a thickness between about 1 nanometer (nm) and about 100 nm.

Clause 30: The method of any one of clauses 25 to 29, wherein the iron nitride-containing thin film defines a thickness between about 1 nanometer (nm) and about 100 nm.

Clause 31: The method of any one of clauses 17 to 30, wherein the layer of material comprises at least one of $Fe_3O_4$, $Fe_2O_3$, $SiO_2$, $TiO_2$, $SO_2$, $Al_2O_3$, MgO, $Si_3N_4$, $CaCO_3$, Au, Ag, or Ru.

Clause 32: The method of any of claims 17 to 31, wherein the layer of material defines a thickness between about 1 nm and about 100 microns (μm).

Clause 33: An article comprising: an iron nitride-containing workpiece comprising at least one $Fe_{16}N_2$ phase domain; and a layer of material that covers at least a portion of an outer surface of the iron nitride-containing workpiece, wherein the material has a different coefficient of thermal expansion than the iron nitride-containing workpiece, and wherein the layer of material exerts at least one of a tensile force or a compressive force on the iron nitride-containing workpiece in at least a direction parallel to an interface between the layer of material and the iron nitride-containing workpiece.

Clause 34: The article of clause 33, wherein the layer of material has a coefficient of thermal expansion that is higher than the coefficient of thermal expansion of the iron nitride-containing workpiece in at least a direction parallel to the interface between the layer of material and strained iron nitride-containing workpiece.

Clause 35: The article of clause 33 or 34, wherein the iron nitride-containing workpiece comprising the at least one $Fe_{16}N_2$ phase domain comprises an iron nitride-containing nanoparticle comprising at least one $Fe_{16}N_2$ phase domain, and wherein the layer substantially encloses the outer surface of the iron nitride-containing nanoparticle.

Clause 36: The article of clause 35, wherein the layer of material has a volumetric coefficient of thermal expansion that is higher than the volumetric coefficient of thermal expansion of the iron nitride-containing nanoparticle.

Clause 37: The article of clause 35 or 36, wherein the layer exerts the compressive force on the iron nitride-containing nanoparticle comprising the at least one $Fe_{16}N_2$ phase domain.

Clause 38: The article of clause 33 or 34, wherein the iron nitride-containing workpiece comprising the at least one $Fe_{16}N_2$ phase domain comprises an iron nitride-containing thin film comprising at least one $Fe_{16}N_2$ phase domain, and wherein the layer of material covers at least a portion of the outer surface of the iron nitride-containing thin film.

Clause 39: The article of clause 38, wherein the layer of material exerts the tensile force on the iron nitride-containing thin film comprising the at least one Fe16N2 phase domain.

Clause 40: The article of clause 38 or 39, wherein at least one underlying layer underlies the iron nitride-containing thin film.

Clause 41: The article of clause 40, wherein the at least one underlying layer comprises a first underlying layer, a second underlying layer, and a third underlying layer, wherein the second underlying layer is disposed between the first underlying layer and the third underlying layer, wherein the first underlying layer is directly underlying the iron nitride-containing thin film, and wherein the first underlying layer comprises silver (Ag), the second underlying layer comprises iron (Fe), and the third underlying layer comprises magnesium oxide (MgO).

Clause 42: The article of clause 41, wherein each of the first underlying layer, the second underlying layer, and the third underlying layer defines a thickness between about 1 nanometer (nm) and about 100 nm.

Clause 43: The article of any one of clauses 38 to 42, wherein the iron nitride-containing thin film defines a thickness between about 1 nanometer (nm) and about 100 nm.

Clause 44: The article of any one of clauses 33 to 43, wherein the layer of material comprises at least one of $Fe_3O_4$, $Fe_2O_3$, $SiO_2$, $TiO_2$, $SO_2$, $Al_2O_3$, MgO, $Si_3N_4$, $CaCO_3$, Au, Ag, or Ru.

Clause 45: The article of any one of clauses 33 to 44, wherein the layer defines a thickness between about 1 nm and about 100 microns (μm).

Clause 46: Any one of clauses 1 to 45, wherein the workpiece is in the form of at least one of a wire, rod, bar, conduit, hollow conduit, film, sheet, or fiber.

EXAMPLES

Figure 12:
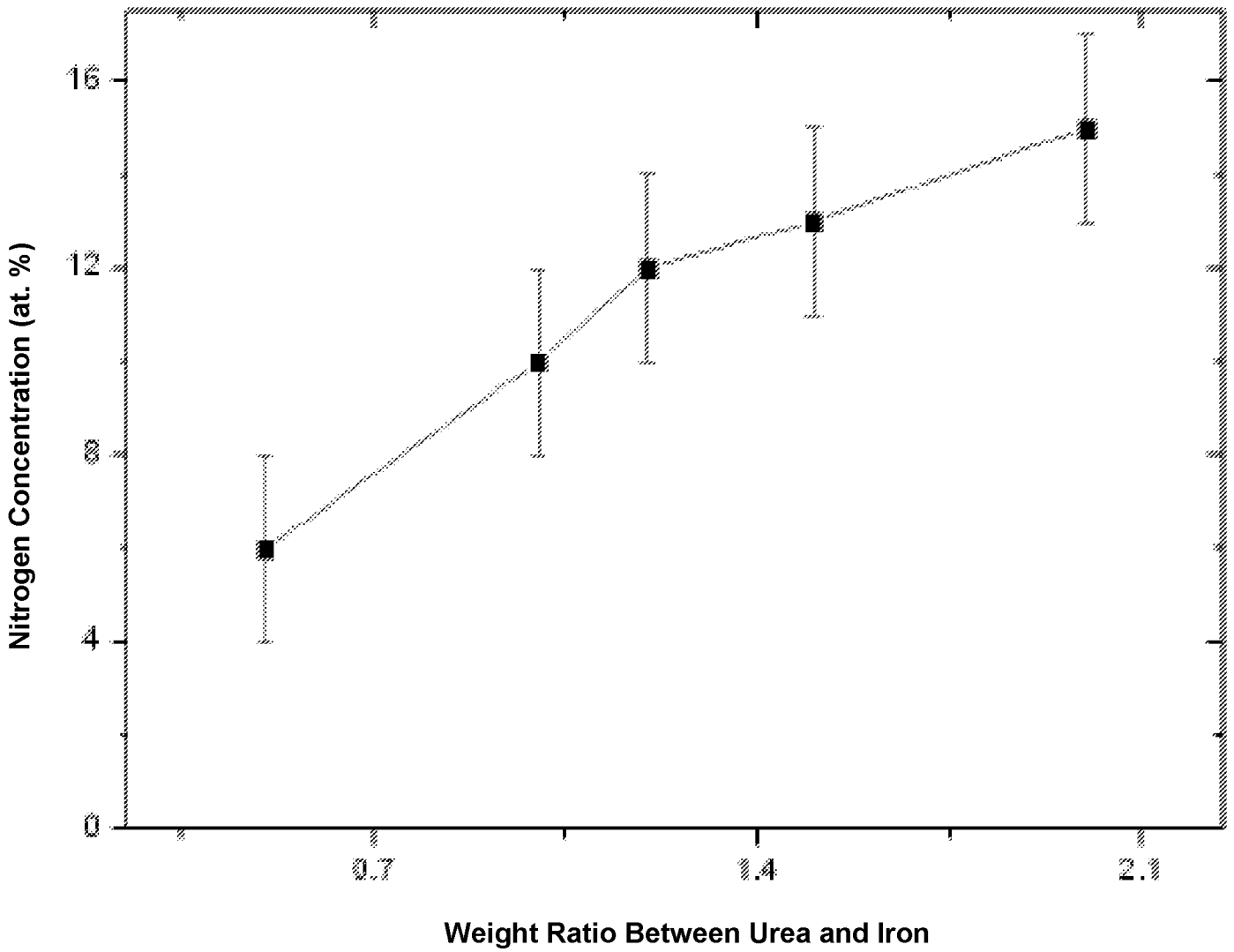

A series of experiments were carried out to evaluate one or more aspects of example iron nitride workpieces described herein. In particular, various example iron nitride materials were formed via urea diffusion and then evaluated. The weight ratio of urea to bulk iron was varied to determine the dependence of the constitution of iron nitride material on this ratio. As shown in FIG. 12, five different examples were formed using urea to iron weight ratios of approximately 0.5 (i.e., 1:2), 1.0, 1.2, 1.6, and 2.0.

For reference, at temperatures above approximately 1573° C., the main chemical reaction process for the described urea diffusion process is:

$$CO(NH_2)_2 \rightarrow NH_3 + HNCO \quad (1)$$

$$HNCO + H_2O \rightarrow 2NH_3 + CO_2 \quad (2)$$

$$2NH_3 \rightarrow 2N + 3H_2 \quad (3)$$

$$2N \rightarrow N_2 \quad (4)$$

Figure 9:
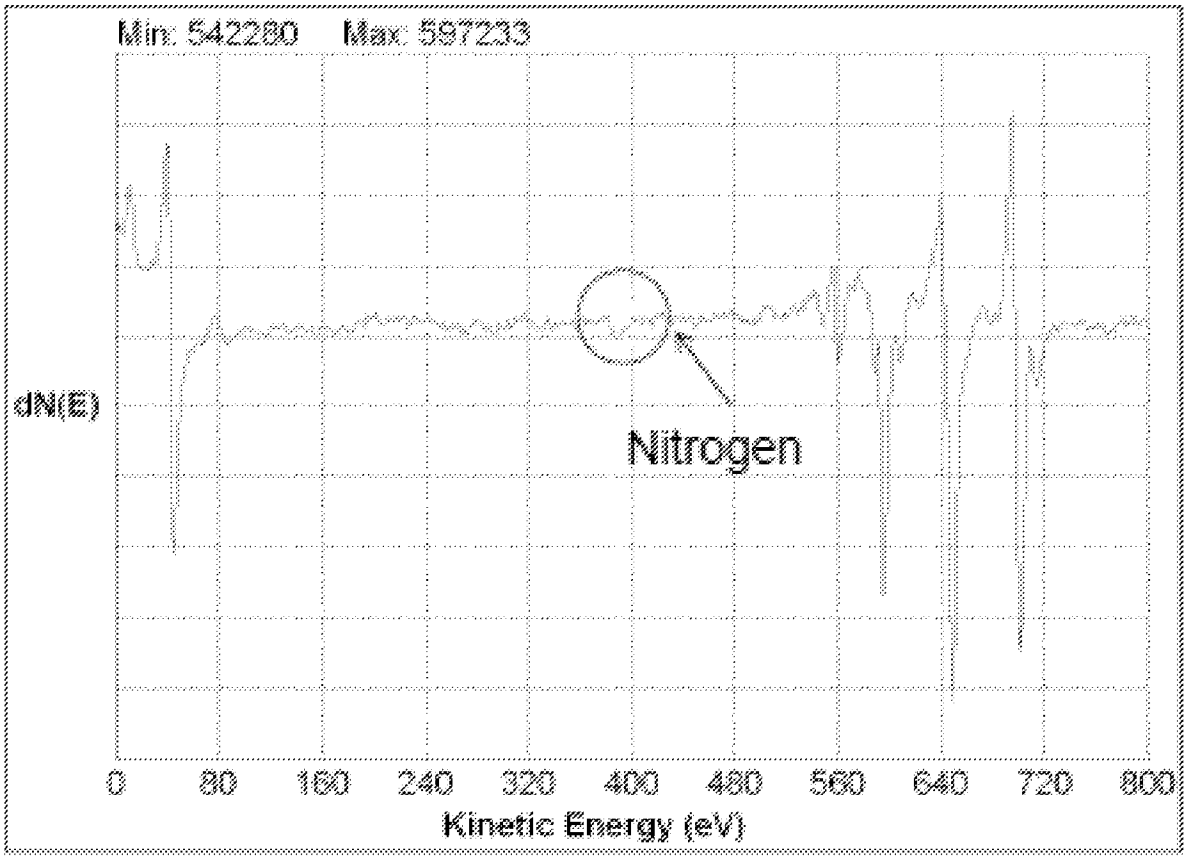
FIGS. 9-12 are graphs of various results for example experiments carried out to illustrate aspects of the disclosure.

In such a reaction process, for the nitrogen atom, it may be relatively easy to recombine into a molecule, as shown in equation (4). Accordingly, in some examples, the recombination of nitrogen atoms may be decreased by placing the urea next to or proximate to the bulk iron material during a urea diffusion process. For example, in some cases, the urea may be in direct contact with the surface of the bulk iron material, or within approximately 1 centimeter of the bulk material The iron nitride samples were prepared according to the urea diffusion process described herein. Following the preparation of the iron nitride sample via the urea diffusion process, Auger electron spectroscopy was used to determine the chemical composition on the surface of the example iron materials. FIG. 9 is a plot of the Auger measurement results for one of the examples, which indicates the presence of nitrogen in the material.

FIG. 12 is plot of weight ratio of urea to bulk iron material used in the urea diffusion process versus nitrogen concentration (at. %) of the final iron nitride material. As noted above, ratios of 0.5 (i.e., 1:2), 1.0, 1.2, 1.6, and 2.0 for urea to bulk iron material were used. As shown in FIG. 12, different weight ratios of urea to iron may lead to different nitrogen concentrations within the iron nitride material following urea diffusion. In particular, FIG. 12 illustrates that the atomic ratio of nitrogen in the iron nitride material increased as the amount of urea used relative to the amount bulk iron increased. Accordingly, in at least some cases, the desired nitrogen concentration of an iron nitride material formed via urea diffusion may be obtained by using the weight ratio of urea to iron in the starting material corresponding to the desired nitrogen concentration.

Figure 10:
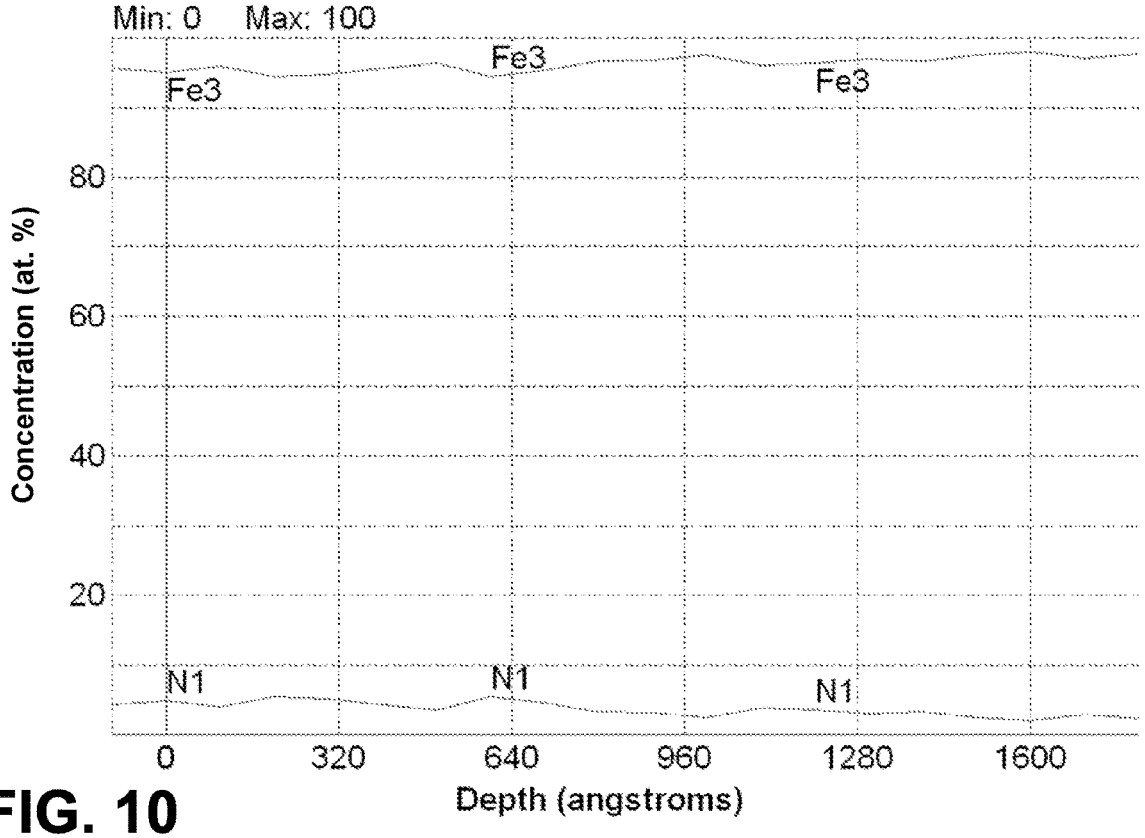

FIG. 10 is plot of depth below the surface of the iron nitride material versus concentration (at. %) for the iron nitride material formed via urea diffusion starting with a weight ratio of urea to iron of approximately 2.0. As shown in FIG. 10, the concentration of nitrogen from the surface of the iron nitride material to approximately 1600 angstroms below the surface of the material was approximately 6 at. %. Moreover, there isn't any trace for oxygen and carbon, which means that other dopant source(s) have been diminished effectively.

Figure 11:
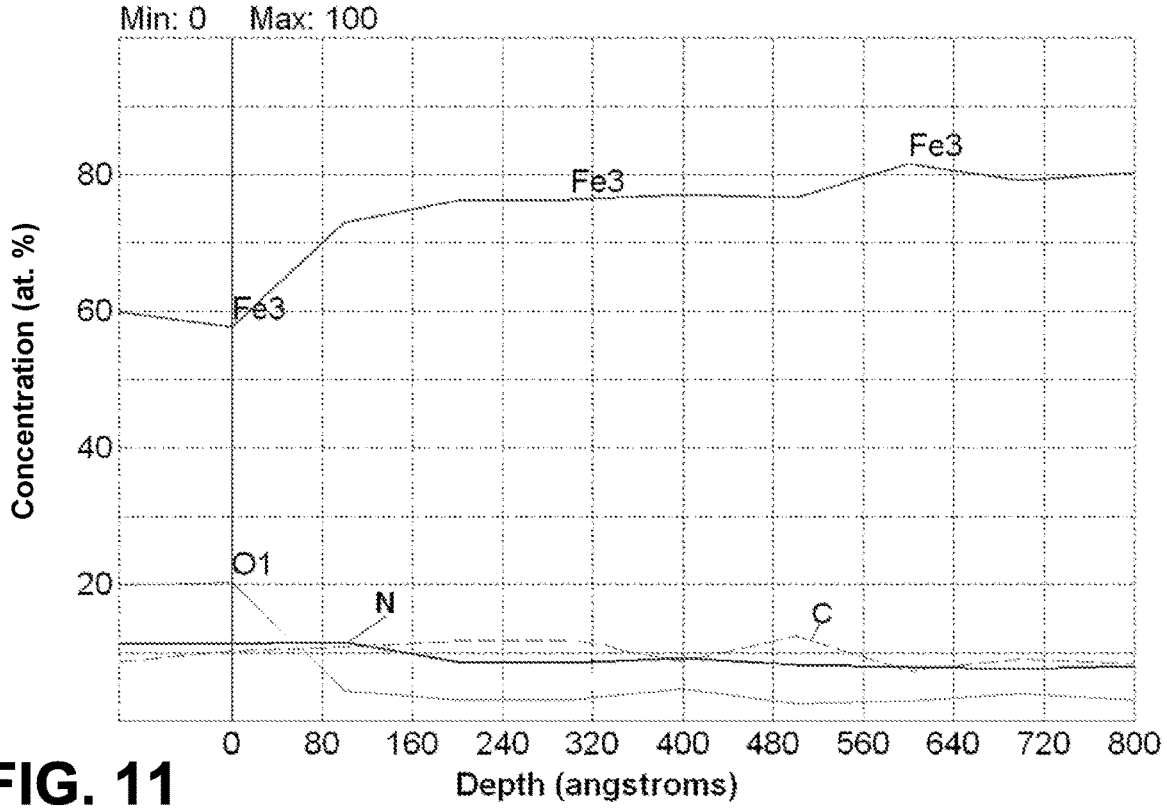

FIG. 11 is a plot of depth below the surface of the iron nitride material versus concentration (at. %) for the iron nitride material formed via urea diffusion starting with a weight ratio of urea to iron of approximately 1.0. As shown in FIG. 11, the concentration of nitrogen from the surface of the iron nitride material to approximately 800 angstroms below the surface of the material was approximately 6-12 at. %. In some examples, the concentration could be reduced further by improving the vacuum system, e.g., such as using pumping system to cause greater flow. As also show, oxygen has been diminished to be about 4 at. %. Although there is over 10 at. % carbon, since it can be considered a substitute element for nitrogen, it has no significant negative effect on the fabricated permanent magnet.

Figure 24A:
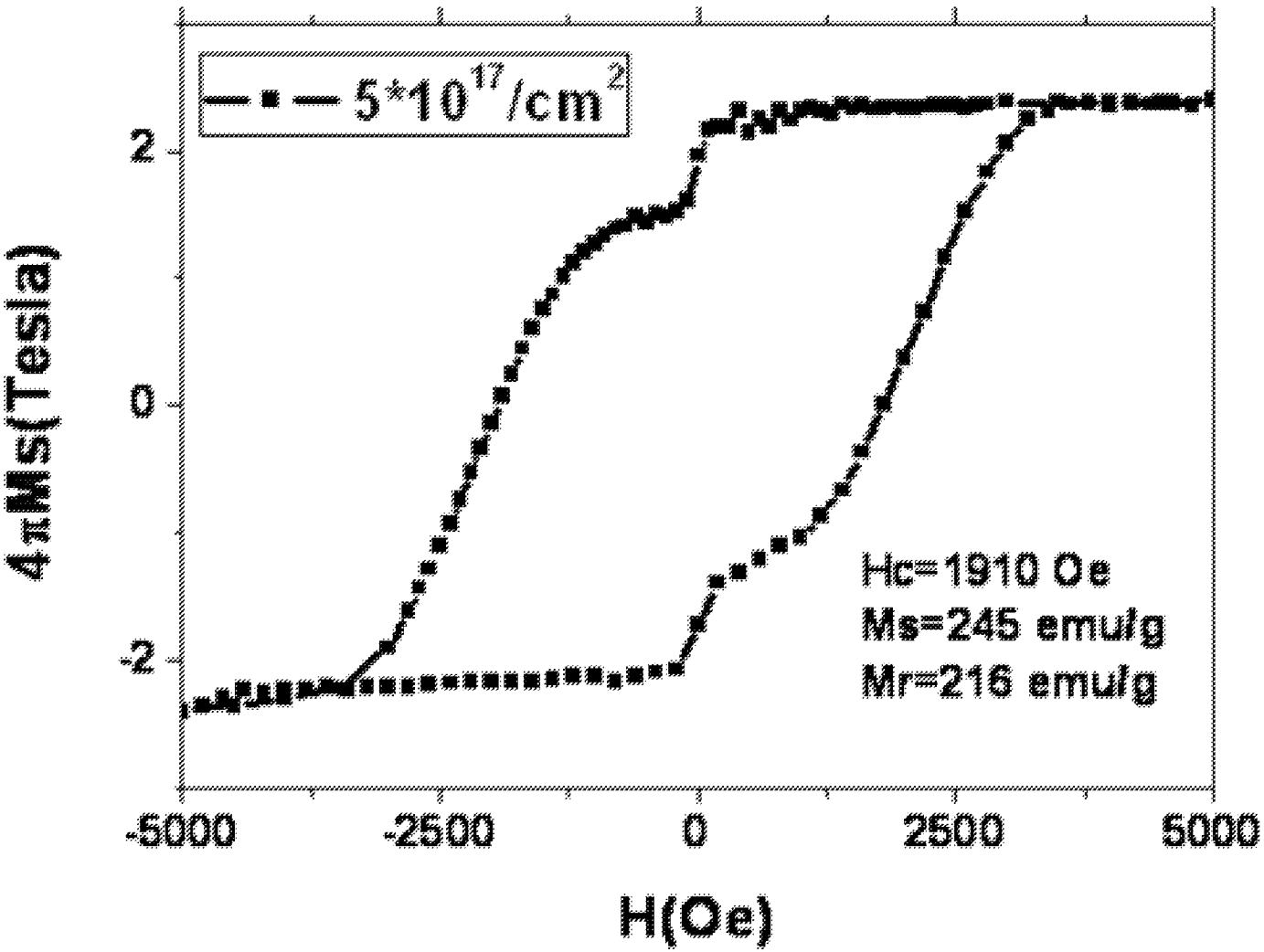
FIG. 24A is a chart illustrating a magnetization curve of an example iron nitride magnet including texture.

FIG. 24A is a chart illustrating a magnetization curve of an example iron nitride magnet including texture. In preparing the iron nitride magnet, an ion implantation technique was applied to a single crystal iron foil. A textured iron nitride magnet including $Fe_{16}N_2$ thus was formed by implanting N+ ions in a single crystal iron foil. The iron nitride magnet sample was prepared with a $5\times10^{17}/cm^2$ fluence after post-annealing. Additional details regarding the ion implantation technique utilized for this example are discussed in International Patent Application Number PCT/US14/15104, which is incorporated herein by reference in its entirety.

The magnetization curve of FIG. 24A shows magnetization in units of $4\pi M_s$ (Tesla) versus coercivity in units of H (Oe), where $M_s$ is the saturation magnetization and Oe is oersteds. The coercivity ($H_c$) of a magnetic material, including the iron nitride magnet tested, may be approximated according to the following equation:

$$Hc = \alpha \times H_k - N_{eff} M_S + \frac{\beta\gamma}{DM_S}$$

In this equation, the element $$\frac{\beta\gamma}{DM_S}$$

may account for texture presented within a magnetic material, where beta (β) is a geometrical term, gamma (γ) is a wall energy, and D is an average grain diameter. In some examples, β may have a value between about 1 and about 5.

Accordingly, a greater degree of texture may be correlated with enhanced coercivity of a magnetic material, such as an $Fe_{16}N_2$ magnetic material. In the remainder of the equation, alpha ($\alpha$) is a parameter for nucleation, where $\alpha=\delta/\pi r_0$, and delta ($\delta$) is given by:

$$\delta = \pi\sqrt{\frac{A}{K_1}}$$

Here, A is an exchange constant, $K_1$ is a first crystalline anisotropy constant, and $r_0$ is the diameter of the nucleus. Referring back to the coercivity equation, $N_{eff}$ is an average demagnetizing factor of the material, and $H_K$ is the anisotropy field. As shown in FIG. 24A, the example iron nitride foil sample tested showed a coercivity ($H_c$) of 1910 Oe, a saturation magnetization ($M_s$) of 245 emu/g, and a remnant magnetization ($M_r$) of 216 emu/g, where emu is electromagnetic units.

Figure 24B:
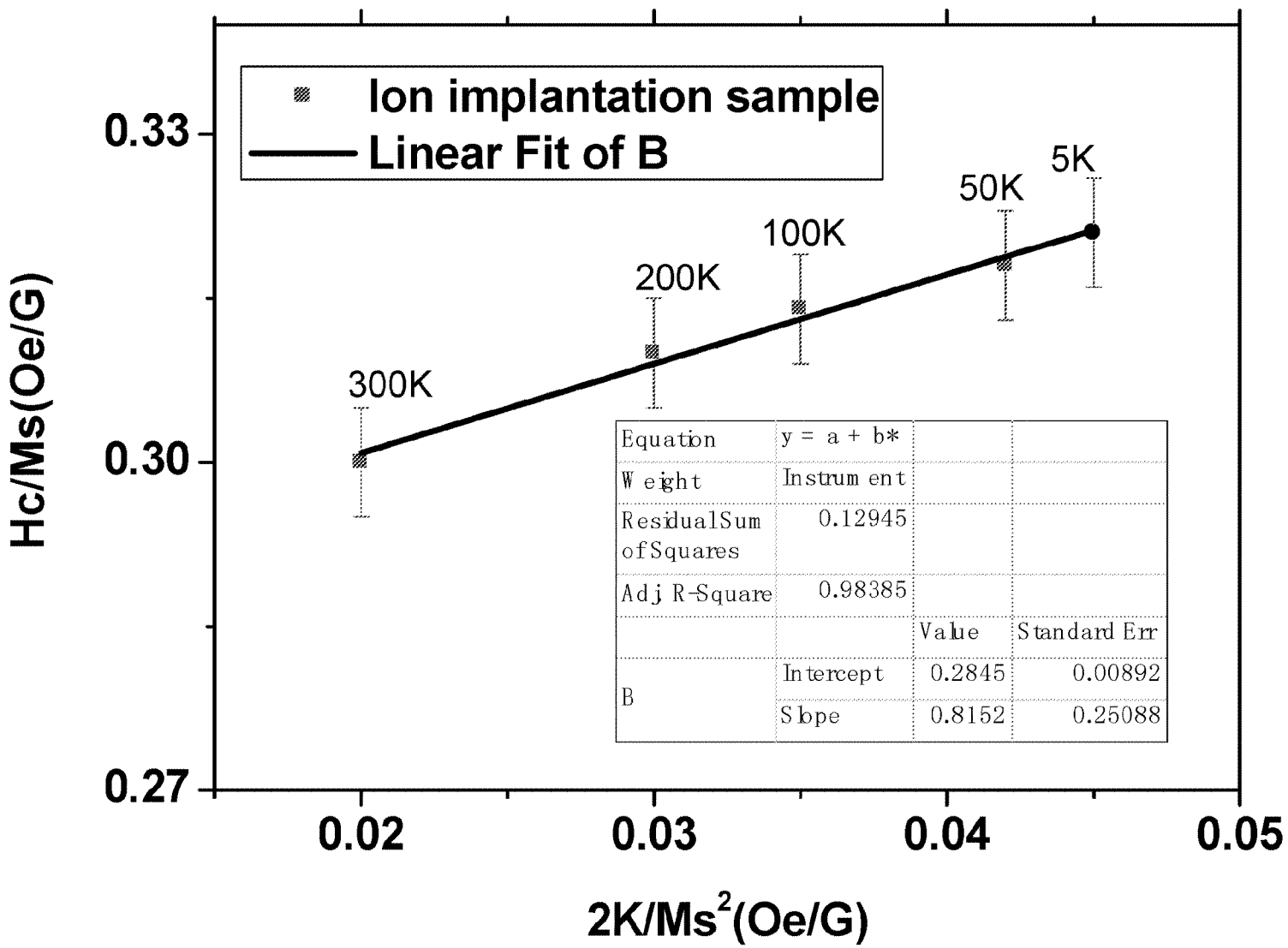
FIG. 24B is a chart illustrating the correlation between HIM, and $(2K/M_s^2)$ for the example iron nitride magnet including texture analyzed in FIG. 24A.

FIG. 24B is a chart illustrating the correlation between $H_c/M_s$ and $(2K/M_s^2)$ for the example iron nitride magnet including texture analyzed in FIG. 24A. The chart of FIG. 24B presents data points sampled with respect to the example iron nitride magnet prepared as discussed with respect to FIG. 21A, at values of 300 K, 200 K, 100 K, 50 K, and 5 K. A line fitted along the data, showing a linear fit of beta ($\beta$) is also shown in FIG. 24B. The slope of the line is 0.8152, while the intercept of the line across they axis is positive. In comparison to other permanent magnets, such as sintered neodymium (e.g., NdFeB) magnets, the iron nitride magnet tested here shows a slope ($\alpha$) higher than most sintered neodymium magnets. Further, a positive intercept along the y axis differentiates the iron nitride material tested from most sintered neodymium magnets.

Figure 25A:
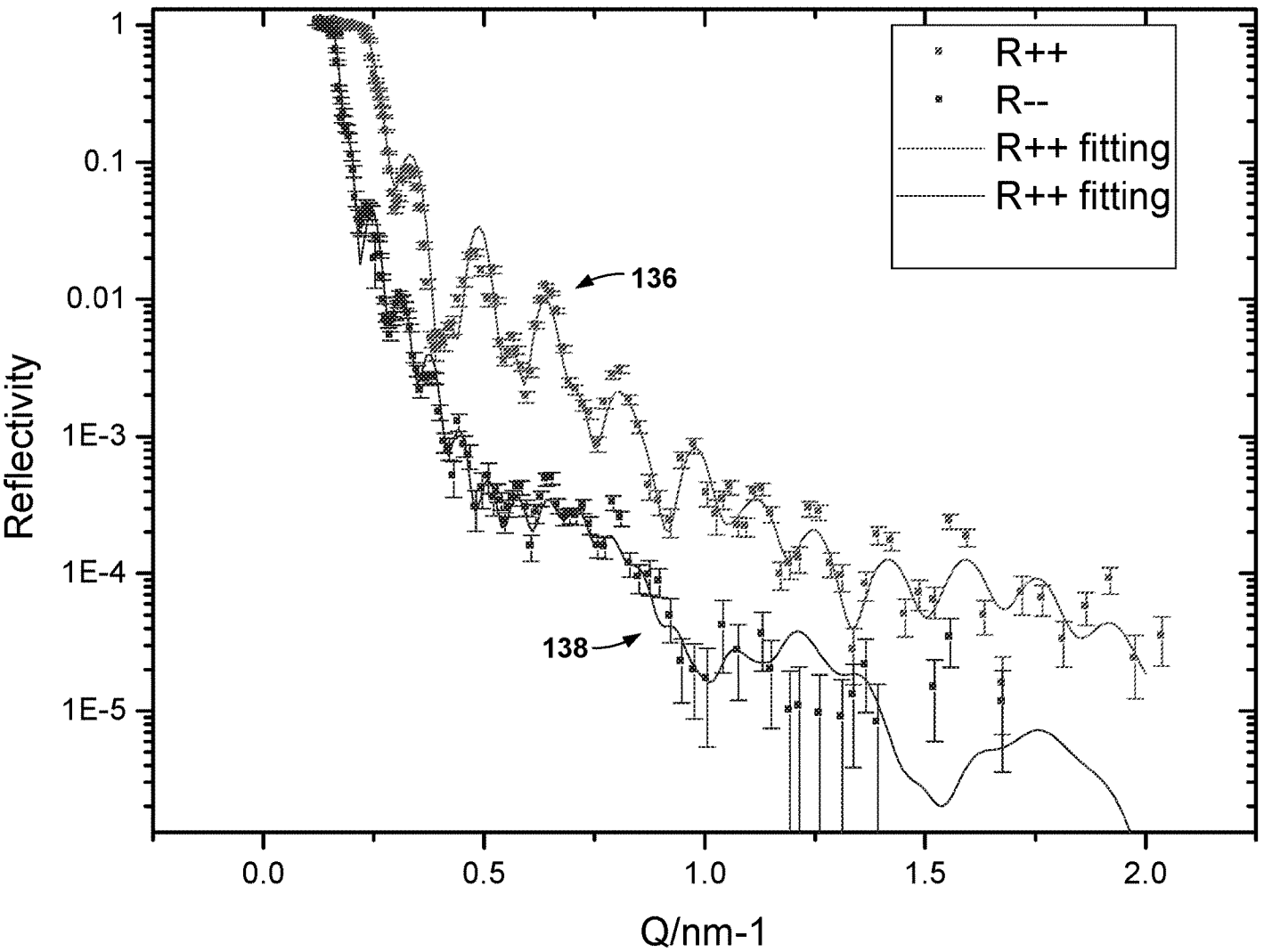
FIG. 25A is a chart illustrating a polarized neutron reflectometry (PNR) result of an iron nitride thin film with a Ruthenium (Ru) coating layer.

FIG. 25A is a chart illustrating a polarized neutron reflectometry (PNR) result of an iron nitride thin film with a Ruthenium (Ru) coating layer. The upper curve 136 on the chart shows a fitted reflectivity curve for polarized neutrons with spin-up (R++) incident on the Ru-coated iron nitride thin film, while the lower curve 138 shows a fitted reflectivity curve for polarized neutrons with spin-down (R−−) incident on the Ru-coated iron nitride thin film.

Figure 25B:
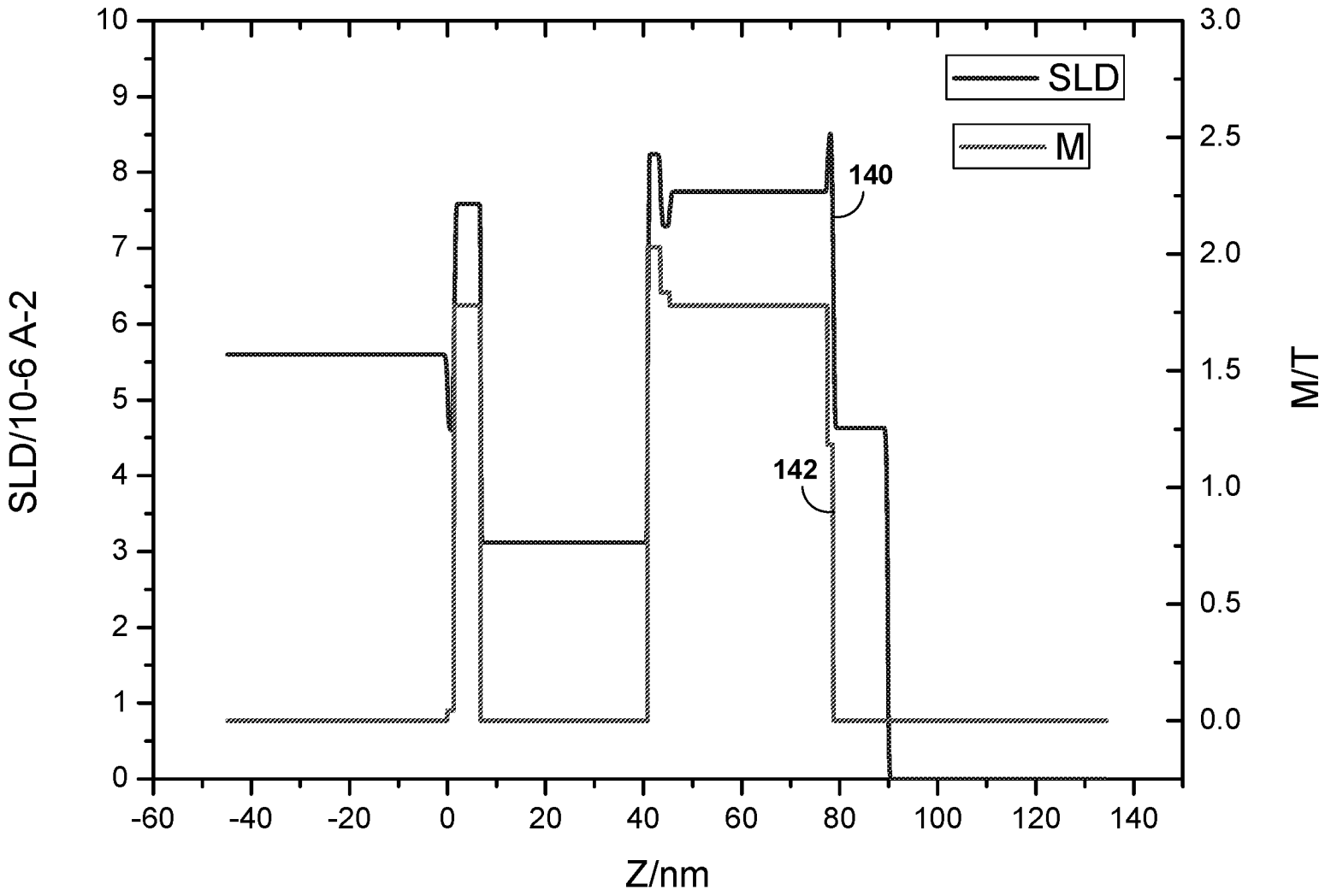
FIG. 25B is a chart illustrating a nuclear scattering length density and field dependent magnetization depth profiles as functions of the distance from the iron nitride thin film with a Ru coating layer of FIG. 25A.

FIG. 25B is a chart illustrating a nuclear scattering length density and field dependent magnetization depth profiles as functions of the distance from the iron nitride thin film with a Ru coating layer of FIG. 25A. The upper curve 140 on the chart shows scattering length density (SLD) values versus depth from the Ru-coated iron nitride thin film (measured in nanometers). The lower curve 142 on the chart shows the magnetization of the Ru-coated iron nitride thin film (measured in Tesla) versus depth from the thin film.

Figure 26A:
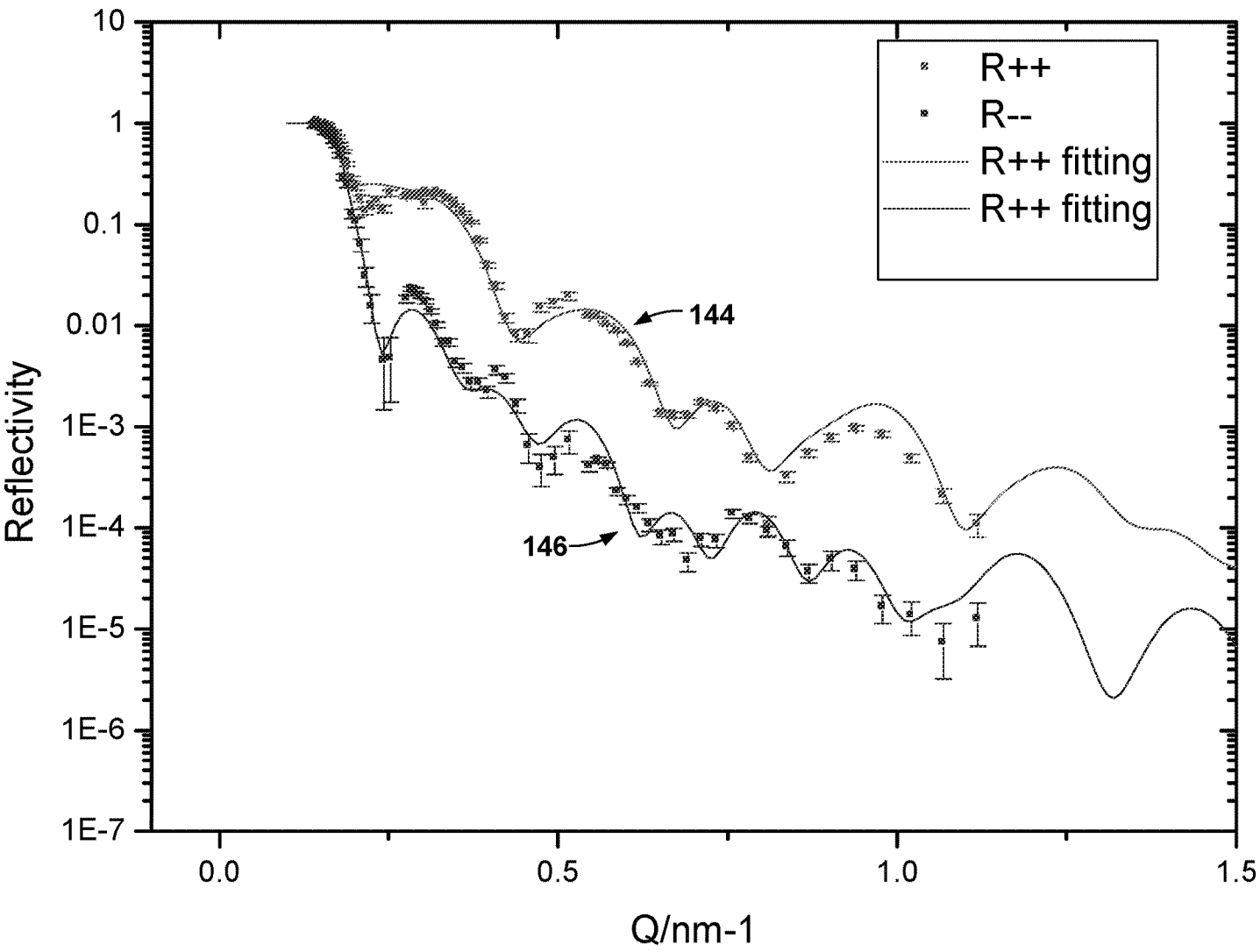
FIG. 26A is a chart illustrating a PNR result of an iron nitride thin film with a silver (Ag) coating layer.

FIG. 26A is a chart illustrating a PNR result of an iron nitride thin film with a silver (Ag) coating layer. The upper curve 144 on the chart shows a fitted reflectivity curve for polarized neutrons with spin-up (R++) incident on the Ag-coated iron nitride thin film, while the lower curve 146 shows a fitted reflectivity curve for polarized neutrons with spin-down (R−−) incident on the Ag-coated iron nitride thin film.

Figure 26B:
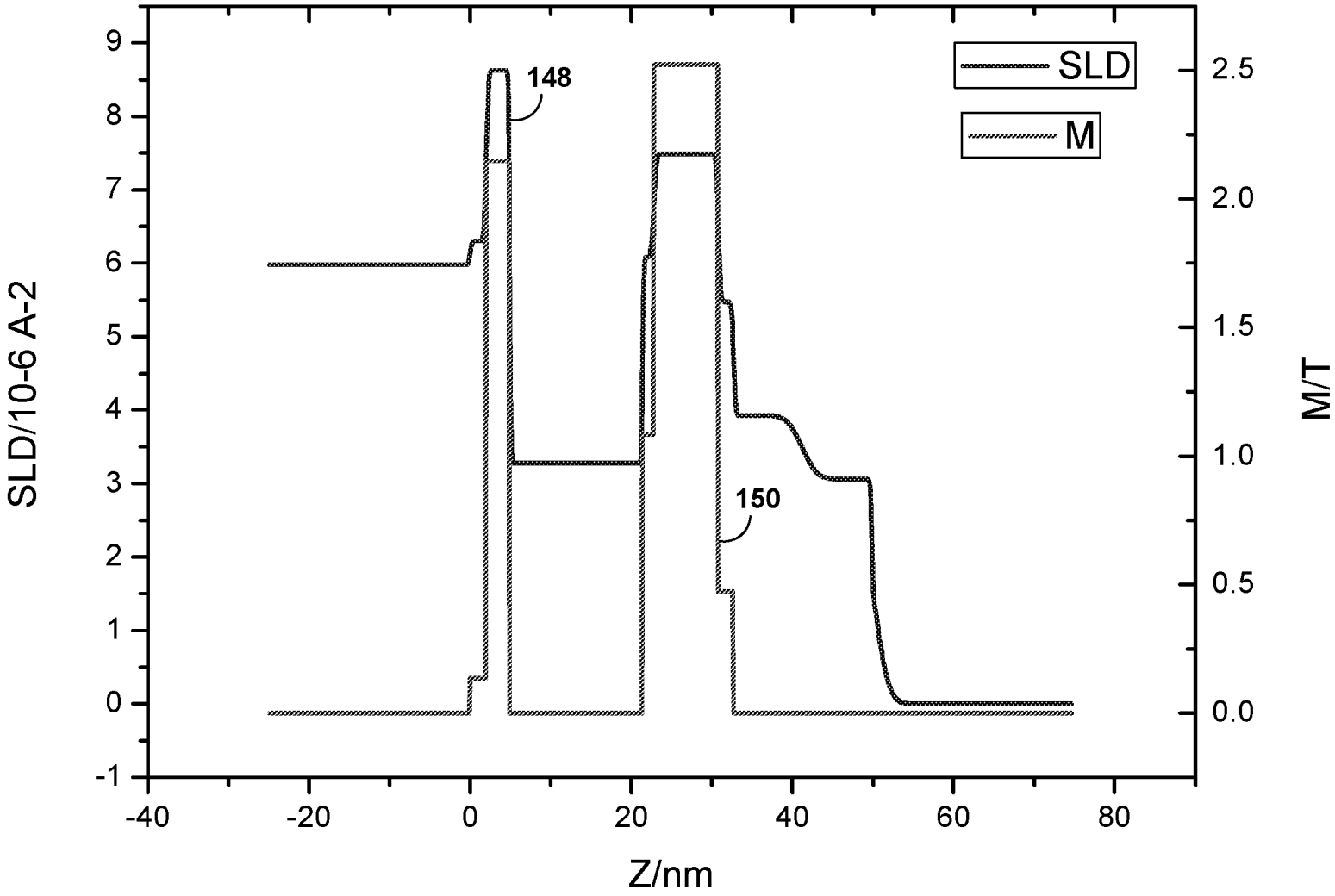
FIG. 26B is a chart illustrating a nuclear scattering length density and field dependent magnetization depth profiles as functions of the distance from the iron nitride thin film with a Ag coating layer of FIG. 26A.

FIG. 26B is a chart illustrating a nuclear scattering length density and field dependent magnetization depth profiles as functions of the distance from the iron nitride thin film with a Ag coating layer of FIG. 26A. The upper curve 148 on the chart shows scattering length density (SLD) values versus depth from the Ag-coated iron nitride thin film (measured in nanometers). The lower curve 150 on the chart shows the magnetization of the Ag-coated iron nitride thin film (measured in Tesla) versus depth from the thin film.

Various examples have been described. These and other examples fall within the scope of the following claims.

The invention claimed is:

1. An article comprising:

a strained iron nitride-containing workpiece comprising at least one $Fe_{16}N_2$ phase domain, wherein at least one $Fe_{16}N_2$ phase has dimensions of at least 0.1 mm; and a layer of material that covers at least a portion of an outer surface of the strained iron nitride-containing workpiece, wherein the material has a different coefficient of thermal expansion than the iron nitride-containing workpiece, and wherein the layer of material exerts at least one of a tensile force or a compressive force on the iron nitride-containing workpiece in at least a direction parallel to an interface between the layer of material and the strained iron nitride-containing workpiece, such that a strained state is preserved;

wherein the workpiece is a permanent magnet.

2. The article of claim 1, wherein the layer of material has a coefficient of thermal expansion that is higher than the coefficient of thermal expansion of the strained iron nitride-containing workpiece in at least a direction parallel to the interface between the layer of material and strained iron nitride-containing workpiece.

3. The article of claim 1, wherein the strained iron nitride-containing workpiece comprising the at least one $Fe_{16}N_2$ phase domain comprises a strained iron nitride-containing nanoparticle comprising at least one $Fe_{16}N_2$ phase domain, and wherein the layer substantially encloses the outer surface of the strained iron nitride-containing nanoparticle.

4. The article of claim 3, wherein the layer of material has a volumetric coefficient of thermal expansion that is higher than the volumetric coefficient of thermal expansion of the strained iron nitride-containing nanoparticle.

5. The article of claim 3, wherein the layer exerts the compressive force on the strained iron nitride-containing nanoparticle comprising the at least one $Fe_{16}N_2$ phase domain.

6. The article of claim 1, wherein the strained iron nitride-containing workpiece comprising the at least one $Fe_{16}N_2$ phase domain comprises a strained iron nitride-containing thin film comprising at least one $Fe_{16}N_2$ phase domain, and wherein the layer of material covers at least a portion of the outer surface of the strained iron nitride-containing thin film.

7. The article of claim 6, wherein the layer of material exerts the tensile force on the strained iron nitride-containing thin film comprising the at least one $Fe_{16}N_2$ phase domain.

8. The article of claim 6, wherein at least one underlying layer underlies the strained iron nitride-containing thin film.

9. The article of claim 8, wherein the at least one underlying layer comprises a first underlying layer, a second underlying layer, and a third underlying layer, wherein the second underlying layer is disposed between the first underlying layer and the third underlying layer, wherein the first underlying layer is directly underlying the strained iron nitride-containing thin film, and wherein the first underlying layer comprises silver (Ag), the second underlying layer comprises iron (Fe), and the third underlying layer comprises magnesium oxide (MgO).

10. The article of claim 9, wherein each of the first underlying layer, the second underlying layer, and the third underlying layer defines a thickness between 1 nanometer (nm) and 100 nm.

11. The article of claim 1, wherein the layer of material comprises at least one of $Fe_3O_4$, $Fe_2O_3$, $SiO_2$, $TiO_2$, $SO_2$, $Al_2O_3$, MgO, $Si_3N_4$, $CaCO_3$, Au, Ag, or Ru.

12. The article of claim 1, wherein the layer defines a thickness between about 1 nm and about 100 microns (μm).

13. An article comprising:

an iron nitride-containing workpiece comprising at least one $Fe_{16}N_2$ phase domain, wherein at least one $Fe_{16}N_2$ phase has dimensions of at least 0.01 mm; and a layer of material that covers at least a portion of an outer surface of the iron nitride-containing workpiece, wherein the material has a different coefficient of thermal expansion than the iron nitride-containing workpiece, and wherein the layer of material exerts at least one of a tensile force or a compressive force on the iron nitride-containing workpiece such that a strained state is preserved to provide a strained iron nitride-containing workpiece in at least a direction parallel to an interface between the layer of material and the strained iron nitride-containing workpiece;

wherein the workpiece is a permanent magnet.

* * * * *